US006457537B1

(12) United States Patent
Mercer et al.

(10) Patent No.: US 6,457,537 B1
(45) Date of Patent: Oct. 1, 2002

(54) MAPPING TOOL FOR TRACKING AND/OR GUIDING AN UNDERGROUND BORING TOOL

(75) Inventors: John E. Mercer, Kent; Peter H. Hambling, Bellevue; Rudolf Zeller, Seattle; Shiu S. Ng, Kirkland; Guenter W. Brune, Bellevue; Lloyd A. Moore, Renton, all of WA (US)

(73) Assignee: Digital Control Incorporated, Renton, WA (US)

( * ) Notice: Subject to any disclaimer, the term of this patent is extended or adjusted under 35 U.S.C. 154(b) by 0 days.

(21) Appl. No.: 10/021,882

(22) Filed: Dec. 13, 2001

Related U.S. Application Data

(60) Continuation of application No. 09/596,316, filed on Jun. 15, 2000, which is a continuation of application No. 09/422,814, filed on Oct. 21, 1999, now Pat. No. 6,095,260, which is a division of application No. 08/835,834, filed on Apr. 16, 1997, now Pat. No. 6,035,951.

(51) Int. Cl.[7] ..... E21B 47/024

(52) U.S. Cl. ..... 175/45; 175/62; 175/202; 250/264; 342/459; 342/463

(58) Field of Search ..... 175/40, 41, 45, 175/57, 61, 62, 202; 250/256, 264; 342/450, 459, 463

(56) References Cited

U.S. PATENT DOCUMENTS 4,054,881 A 10/1977 Raab ..... 343/112 R
4,314,251 A 2/1982 Raab ..... 343/112 R
4,468,863 A * 9/1984 Van Steenwyk
4,472,884 A * 9/1984 Engebretson
4,710,708 A 12/1987 Rorden et al. ..... 324/207
4,806,869 A * 2/1989 Chau et al. ..... 175/45 X
4,909,336 A * 3/1990 Brown et al.
4,968,978 A * 11/1990 Stolarczyk ..... 175/40 X
4,993,503 A * 2/1991 Fischer et al.
5,066,917 A * 11/1991 Stolarczyk ..... 324/358
5,070,462 A * 12/1991 Chau ..... 364/460
5,089,779 A * 2/1992 Rorden
5,155,442 A * 10/1992 Mercer ..... 324/690
5,231,355 A * 7/1993 Rider et al.
5,268,683 A * 12/1993 Stolarczyk ..... 175/40 X
5,337,002 A 8/1994 Mercer ..... 324/326
5,682,099 A * 10/1997 Thompson et al.
6,035,951 A * 3/2000 Mercer et al.
6,047,783 A * 4/2000 Mercer et al.
6,095,260 A * 8/2000 Mercer et al.

* cited by examiner

*Primary Examiner*—Roger Schoeppel
(74) *Attorney, Agent, or Firm*—Michael Pritzkau

(57) ABSTRACT

A portable mapping tool for use in a horizontal drilling system and associated methods use a boring tool configured for transmitting a locating signal. The mapping tool also includes at least one electromagnetic field detector which is configured for measuring the locating signal from a fixed position proximate to the surface of the ground in a drilling area. The mapping tool includes a housing and a transmitter arrangement supported by the housing for transmitting a setup locating signal for reception by the detector in the region for use in determining certain initial conditions at least prior to drilling. The associated mathods include the step of configuring the mapping tool for transmitting a setup locating signal for reception by the detector in the region and using the received setup locating signal in determining certain initial conditions at least prior to drilling.

32 Claims, 15 Drawing Sheets

CONFIGURATION 4

MAPPING TOOL FOR TRACKING AND/OR GUIDING AN UNDERGROUND BORING TOOL

This is a continuation application of copending prior application Ser. No. 09/596,316 filed on Jun. 15, 2000 which is a continuation application of prior application Ser. No. 09/422,814 filed on Oct. 21, 1999 and now issued as U.S. Pat. No. 6,095,260, which is a divisional of application Ser. No. 08/835,834, filed on Apr. 16, 1997 and now issued as U.S. Pat. No. 6,035,951, the disclosures of which are incorporated by reference.

BACKGROUND OF THE INVENTION

The present invention relates generally to systems, arrangements and methods for tracking the position of and/or guiding an underground boring tool during its operation and more particularly to tracking the position of the boring tool within a coordinate system using magnetic field intensity measurements either alone or in combination with certain physically measurable parameters. Positional information may then be used in remotely guiding the boring tool.

SUMMARY OF THE INVENTION

As will be described in more detail hereinafter, there are disclosed herein portable mapping tool arrangements and associated methods for use in a horizontal drilling system. The portable mapping tool includes a boring tool configured for transmitting a locating signal and at least one electromagnetic field detector which is configured for measuring the locating signal from a fixed position proximate to the surface of the ground in a drilling area. In one embodiment, the mapping tool includes a housing and a transmitter arrangement supported by the housing for transmitting a setup locating signal for reception by the detector in the region for use in determining certain initial conditions at least prior to drilling.

The certain initial conditions may include the position of the detector in the region. The detector may be positioned at a known location on the surface of the ground at the fixed position and the certain initial conditions may include an unknown position of the portable mapping tool at another location in the region relative to the detector at the known location.

The portable mapping tool may include at least a first detector and a second detector at respective first and second spaced apart positions on the surface of the ground and wherein the certain initial conditions include the second position of the second detector relative to the first position of the first detector. Alternatively, the portable mapping tool may include a drill rig for actuating the boring tool from a drilling position in the region and the certain initial conditions include the drilling position relative to an at least temporarily fixed position of the portable mapping tool in the region.

In another embodiment, the locating signal transmitted by the boring tool is a first dipole field and the setup locating signal transmitted by the portable mapping tool is a second dipole field.

In another embodiment, the portable mapping tool includes a positioning arrangement cooperating with the housing for positioning the mapping tool, at least temporarily, on the detector in a predetermined way such that the orientation of the mapping tool is fixed relative to the detector on which it is positioned. The positioning arrangement includes an indexing configuration for engaging the detector in the predetermined way to temporarily fixedly maintain the orientation of the portable mapping tool relative to the detector. The indexing configuration includes a plurality of indexing pins in a configuration for engaging the detector in the predetermined way to temporarily fixedly maintain the orintation of the portable mapping tool relative to the detector.

The portable mapping tool may further include an arrangement within the housing for determining certain orientation parameters when the mapping tool is engaged with the detector. In one version, this orientation determining arrangement of the mapping tool includes a configuration for determining the magnetic orientation of the mapping tool and, thereby, the magnetic orientation of the detector when engaged therewith. This configuration may include a magnetometer and/or a tilt sensing arrangement for determining the tilt of the mapping tool and, thereby, the tilt of the detector when engaged therewith.

In other embodiments, the portable mapping tool may include a processing section remote from the portable mapping tool. In this case, the portable mapping tool may include a telemetry arrangement for transferring the certain orientation parameters to the processing section. Various embodiments of the portable mapping tool may also include a display arrangement for displaying the certain orientation parameters.

BRIEF DESCRIPTION OF THE DRAWINGS

The present invention may be understood by reference to the following detailed description taken in conjunction with the drawings, in which.

DETAILED DESCRIPTION OF THE INVENTION

Figure 1:
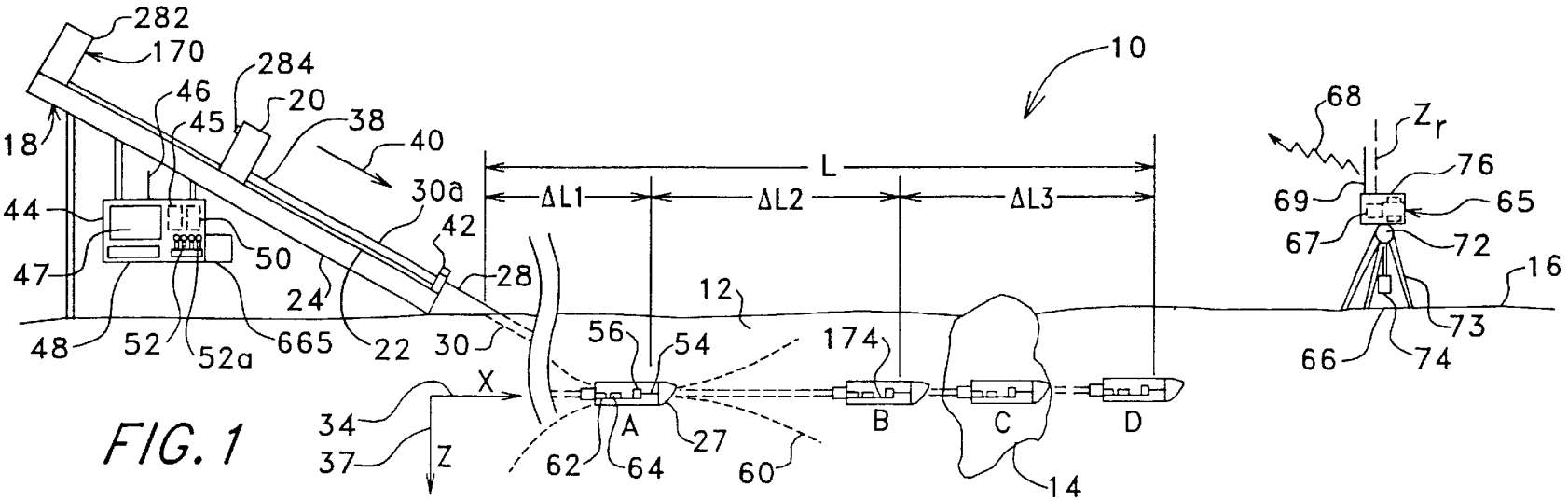
FIG. 1 is a diagrammatic elevational view of a horizontal boring operation being performed in a region using one horizontal boring tool system manufactured in accordance with the present invention.
Figure 2:
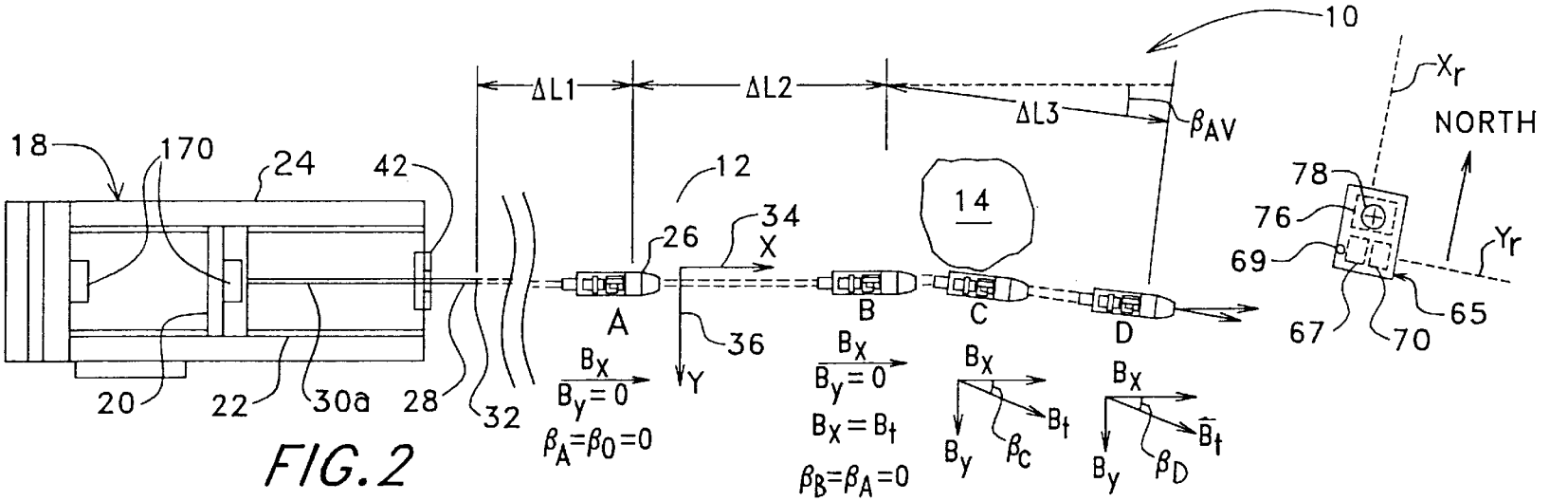
FIG. 2 is a diagrammatic plan view of the region of FIG. 1 further illustrating aspects of the horizontal boring operation being performed.

Attention is immediately directed to FIGS. 1 and 2 which illustrate a horizontal boring operation being performed using a boring/drilling system which is manufactured in accordance with the present invention and generally indicated by the reference numeral 10. The drilling operation is performed in a region of ground 12 including a boulder 14. The surface of the ground is indicated by reference numeral 16 and is substantially planar for present purposes of simplicity.

System 10 includes a drill rig 18 having a carriage 20 received for movement along the length of an opposing pair of rails 22 which are, in turn, mounted on a frame 24. A conventional arrangement (not shown) is provided for moving carriage 20 along rails 22. A boring tool 26 includes an asymmetric face 27 and is attached to a drill string which is composed of a plurality of drill pipe sections 30. The underground progression of boring tool 26 is indicated in a series of points A through D. It should be noted that, for purposes of clarity, the present example is limited to planar movement of the boring tool within a master xy coordinate system wherein the vertical axis is assumed to be nonexistent, although vertical displacement will be taken into account hereinafter, as will be seen. The origin of the master coordinate system is specified by reference numeral 32 at the point where the boring tool enters the ground. While a Cartesian coordinate system is used as the basis for the master coordinate systems employed by the various embodiments of the present invention which are disclosed herein, it is to be understood that this terminology is used in the specification and claims for descriptive purposes and that any suitable coordinate system may be used. An x axis 34 extends forward along the intended path of the boring tool, as seen in FIG. 1, while a y axis 36 extends to the right when facing in the forward direction along the x axis, as seen in FIG. 2. Further descriptions which encompass a z axis 37 (FIG. 1) will be provided at appropriate points in the discussion below.

As the drilling operation proceeds, respective drill pipe sections are added to the drill string at the drill rig. For example, the most recently added drill pipe section 30*a* is shown on the drill rig. An upper end 38 of drill pipe section 30*a* is held by a locking arrangement (not shown) which forms part of carriage 20 such that movement of the carriage in the direction indicated by an arrow 40 causes section 30*a* to move therewith, which pushes the drill string into the ground thereby advancing the boring operation. A clamping arrangement 42 is used to facilitate the addition of drill pipe sections to the drill string. The drilling operation is controlled by an operator (not shown) at a control console 44 which itself includes a telemetry receiver 45 connected with a telemetry receiving antenna 46, a display screen 47, an input device such as a keyboard 48, a processor 50, and a plurality of control levers 52 which, for example, control movement of carriage 20. In particular, lever 52*a* controls clamping arrangement 42, as will be described at an appropriate point below.

Boring tool 26 includes a mono-axial antenna such as a dipole antenna 54 which is driven by a transmitter 56 so that a magnetic locating signal 60 is emanated from antenna 54. Power may be supplied to transmitter 56 from a set of batteries 62 via a power supply 64. For descriptive purposes, the boring tool apparatus may be referred to as a sonde. In accordance with the present invention, an antenna cluster receiver 65 is positioned at a point 66 within the master xy coordinate system for receiving locating signal 60. Antenna cluster 65 is configured for measuring components of magnetic locating signal 60 along one receiving axis or, alternatively, along two or more orthogonal receiving axes, which are referred to herein as $x_r$, $y_r$ and $z_r$ defined within the antenna cluster and depending on the specific system configuration being used. For the moment, it is sufficient to note that the receiving axes within the antenna cluster may be defined by individual antennas such as, for example, dipole antennas (not shown) or by an antenna structure 67. It should also be noted that the antenna cluster receiving axes are not necessarily aligned with the x, y and z axes of the master coordinate system, as is evident in FIG. 2. One antenna structure, which is highly advantageous within the context of the present invention, will be described in detail at an appropriate point below. Measured magnetic field components of the locating signal, in terms of the master coordinate system, are denoted as $B_x$, $B_y$ and $B_z$, in terms of the receiving axes of the antenna cluster, measured components of magnetic locating signal 60 are referred to as $B_{xr}$, $B_{yr}$ and $B_{zr}$. Magnetic information measured along the receiving axes of antenna cluster 65 may be transmitted to processor 50 in operator console 44 in the form of a telemetry signal 68 which is transmitted from a telemetry antenna 69 and associated telemetry transmitter 70. Telemetry signal 68 is picked up at the drill rig using telemetry receiving antenna 46 and telemetry receiver 45. Thereafter, the telemetry information is provided to processor 50 such that the magnetic field information gained along the antenna cluster receiving axes may be interpreted so as to determine the position of the boring tool in the master coordinate system, as will be described. Magnetic field information may be preprocessed using a processor (not shown) located within antenna cluster 65 in order to reduce the amount of information which is transmitted from the antenna cluster to the operator console 44. The $B_x$ and $B_y$ components are illustrated for each of points A–D in FIG. 2 ($B_z$=0 in the present example). A number of different configurations of system 10 will be described below with reference to FIGS. 1 and 2. These configurations may differ in one aspect by the number of orthogonal magnetic field components which are measured by antenna cluster 65. In another aspect, these configurations may utilize inputs other than the magnetic field components and, consequently, may compute the location of the boring tool in alternative ways, as will be discussed at appropriate points below.

In order to derive useful information from magnetic locating signal 60, a number of initial conditions must be known and may be specified in relation to the master coordinate system prior to drilling. The number of initial conditions depends on details of the set up and data processing. There must be sufficient known initial conditions such that the procedure is well posed mathematically, as is known to those of skill in the art. These initial conditions include (1) the transmitted strength of magnetic locating signal 60, (2) an initial yaw ($\beta_o$) of dipole antenna 54 in the master coordinate system (which is measured from the master x axis and is 0° in the present example, since dipole 54 is oriented along the x axis), (3) an initial pitch $\phi_o$ of dipole antenna 54 which is also zero in this example, (4) the location of antenna cluster 65 within the master coordinate system, (5) the initial orientation angles of the receiving axes of the antenna cluster relative to the master xy coordinate plane and (6) the initial location of the boring tool, for example, at origin 32 within the master coordinate system. The main purpose for obtaining initial yaw and initial pitch is to improve tracking and/or guiding accuracy and may therefore not be needed for some applications. One relatively straightforward setup technique to initially establish these six conditions, that is, for initially orienting the components of the system is to aim one receiving axis, for example, $x_r$ of antenna cluster 65 due north and level, as seen in FIG. 2. In one embodiment of system 10, antenna cluster 65 is supported by a gimbal 72 and tripod 73 having a counterweight 74 extending whereby to ensure that the antenna cluster is also maintained in a level orientation. Aiming the antenna axis in the northerly direction may be accomplished using a magnetometer 76 which is built into the receiver and includes a display 78 (FIG. 2) on an upper surface thereof. Initial conditions may be entered into system 10, for example, using keyboard 48.

It is to be understood that any number of other techniques and/or instruments may be used to establish the initial conditions. For example, a tilt sensor (not shown) may be used at antenna cluster 65 in place of the gimbal and counterweight arrangement depicted. As another example, the need for a magnetometer in the antenna cluster may be eliminated by orienting the cluster in a specific direction such as, for example, directing (not shown) $x_r$ parallel with the master x direction. Moreover, it should be appreciated that by knowing a number of the initial conditions, the remaining initial conditions may then be calculated. As an example, if the location of the antenna cluster in the master coordinate system is physically measured such that the initial distance between dipole 54 and the antenna cluster are known and the orientation of the antenna(s) within the antenna cluster are known, system 10 may calculate the signal strength of dipole 54 and its initial yaw angle ($\beta_o$) wherein $\beta_o$ is used as an initial condition and signal strength is applied as a constant for the remainder of the drilling operation.

Figure 3:
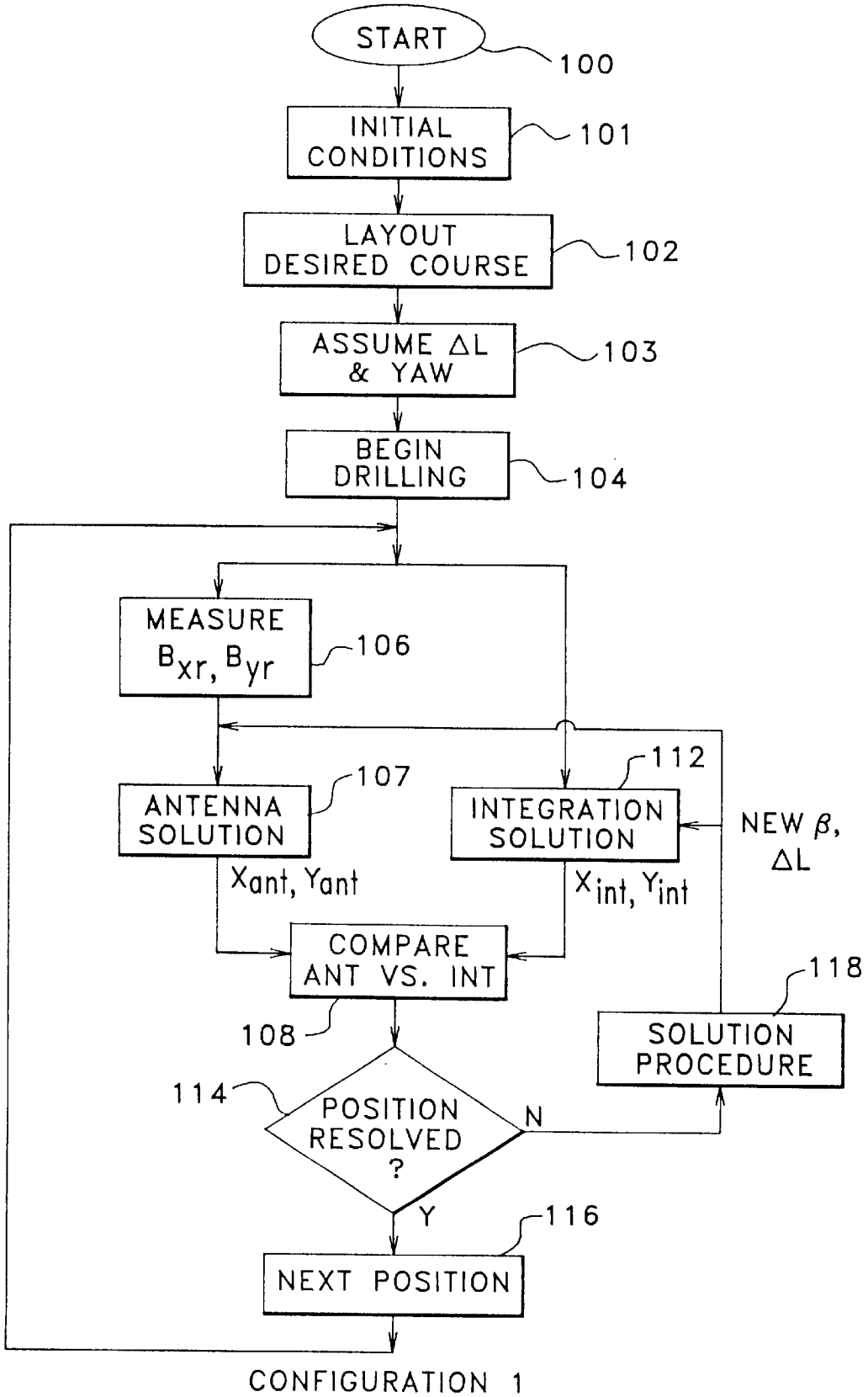
FIG. 3 is a flow diagram illustrating an exemplary, planar procedure for determining the position of the boring tool of FIGS. 1 and 2 in two dimensions using two measured components of a magnetic locating signal emanated from a dipole antenna within the boring tool.

Referring to FIG. 3 in conjunction with FIGS. 1 and 2, the initial conditions recited above are established in step 101 following start step 100. At step 102, a desired course for the drill run may be laid out and entered into the system using operator console 44 so as to be displayed on display panel 47. An exemplary course will be illustrated at an appropriate point below in conjunction with a description of specific provisions for guiding the boring tool along this course. At step 103, initial values are assumed for ΔL and β (yaw) which may be based on the initial conditions determined in step 101. The drilling operation may proceed at step 104 during which incremental movements of the boring tool may be precisely described for two dimensions by the equations:

$$\Delta x = \int \cos \beta(l)\, d1, \text{ and} \tag{1}$$

$$\Delta y = \int \sin \beta(l)\, dl \tag{2}$$

In moving from origin 32 to point A, the boring tool moves a first incremental distance $\Delta L_l$ at the initially established value of $\beta_o$=0°. For the present configuration, it is assumed that the boring tool travels straight in the direction in which it is pointed such that the value of β is unchanged. Under the assumption of a two-dimensional boring process the above equations of a particular increment, ΔL, become:

$$\Delta x = \Delta L \cos \beta, \text{ and} \tag{3}$$

$$\Delta y = \Delta L \sin \beta \tag{4}$$

wherein $\Delta L = \Delta L_l$ and $\beta_l = \beta_o$ for the first incremental movement. Upon reaching point A, the system determines the position of the boring tool in two different ways, that is, along parallel paths beginning with steps 106 and 112. In step 106, which provides for one way to determine the position of the boring tool, the present configuration (which is Configuration 1 in Table 1, below) uses only measured components $B_{xr}$ and $B_{yr}$ (referred to the antenna cluster 65) of the intensity of magnetic locating signal 60, measured in step 106, in determining the position of the boring tool. This configuration is indicated as Configuration 1 in Table 1 below.

TABLE 1

| | System Configurations | | | | | |
|---|---|---|---|---|---|---|
| | Config. 1 | Config. 2 | Config. 3 | Config. 4 | Config. 5 | Config. 6 |
| ΔL | | | ✓ | ✓ | ✓ | ✓ |
| ϕ | n/a | | n/a | ✓ | ✓ | |
| $B_{xr}$ | ✓ | ✓ | ✓ | | ✓ | ✓ |
| $B_{yr}$ | ✓ | ✓ | ✓ | ✓ | ✓ | ✓ |
| $B_{zr}$ | n/a | ✓ | n/a | | ✓ | ✓ |
| S | ✓ | ✓ | ✓ | ✓ | ✓ | ✓ |

(✓indicates a measured or known value)
(n/a indicates a lanar configuration in which ϕ and the z axis are not considered)

As will be appreciated, by knowing $\beta_o$ (established as an initial condition) and knowing the received value of components $B_{xr}$ and $B_{yr}$, respectively, of magnetic locating signal 60 present at antenna cluster 65, but not knowing or assuming a value for $\Delta L_l$, an x,y position of the boring tool may nevertheless be calculated in an antenna solution step 107, under the assumption that the boring tool traveled in the direction of $\beta_o$, using the following well known dipole equations in two dimensions:

$$B_{xr} = \frac{3x_s^2 - r^2}{R^5}, \tag{5}$$

$$B_{yr} = \frac{3x_s y_s}{R^5}, \quad \text{and} \tag{6}$$

$$R^2 = x_s^2 + y_s^2 \tag{7}$$

Here R is the distance between the sonde and receiving antenna cluster and $x_s$, $y_s$ are coordinates moving with the sonde during the boring process. By applying appropriate coordinate transformations which will be described at an appropriate point below, the x, y position of the boring tool can be determined from antenna signals $B_{xr}$ and $B_{yr}$ along with yaw angle β.

Still referring to FIGS. 1–3, integration solution step 112, which provides a second way to determine the position of the boring tool at point A, continues to apply the assumption that the boring tool travels in the direction in which it is pointed by using $\beta_o$ and it also assumes a value for $\Delta L_l$ at point A (i.e., it makes an educated guess). Using these values along with the x and y values from the last known/calculated position of the boring tool, step 112 computes an $x_{int}$, $y_{int}$ position for boring tool 26 using:

$$x_{int=x+\Delta x,\ and} \tag{8}$$

$$y_{int-y-\Delta y} \tag{9}$$

wherein Δx and Δy are provided using equations 3 and 4 and wherein x and y are used from the last known or calculated position of the boring tool. For example, in performing these calculations for point A, x=y=0 since the last known position of the boring tool was at origin 32. Once the tool has moved beyond point A, values for the next point (B) will be calculated using x and y values established for point A in the procedure currently under description. Essentially, step 112 provides an historical track record of the path over which the tool has moved, monitoring both its immediately prior position and yaw for each incremental movement along the path and updating the position and yaw with successive increments. Next a compare step 108 receives the calculated position $x_{ant}$, $y_{ant}$ from step 107 and the integration solution position $x_{int}$, $y_{int}$ from step 112. The compare step checks the two positions against one another and sends the difference to a position resolved step 114. If the $x_{int}$, $y_{int}$ position agrees with the $x_{ant}$, $y_{ant}$ position, if the square difference between the positions is less than a predetermined amount, for example, by less than one square inch or if the result cannot be reduced further by continued iteration, the result is assumed to be correct and step 116 is next performed such that the system loops back to steps 106 and 112 so as to take measurements following the next ΔL movement . If, however, the positions do not agree, a solution procedure step 118 is next performed. The latter estimates a new value for β. Estimation of the new β value may be performed using a number of techniques which are known in the art for converging values of variables such as, for example, Simplex or steepest descent. These procedures determine the sensitivity of the error to changes in the variables and select increments of the variables which will drive the error toward zero. The new values are assumed by the system for the point/position being considered. The newly assumed β is then returned to steps 112 and 107. Steps 107 and 112 compute new $x_{int}$, $y_{int}$ and $x_{ant}$, $y_{ant}$ positions, respectively, for use compare step 108 and then the agreement between the two new positions is checked by step 114. The system continues assuming and testing new values for β until such time that the position of the boring tool is sufficiently resolved, as evidenced by passing the decision test of step 114. The values of $\Delta L_l$ and $\beta_A$ which satisfy this iteration process then become the most recent end point within the integration solution (from a history standpoint), as the drilling operation proceeds.

From point A, drilling continues so that the boring tool moves to point B. As can be seen, the tool actually does move over increment $\Delta L_2$ in a straight path at $\beta_A$, similar to its movement over $\Delta L_l$ to point A. In our particular example, since the boring tool happens to continue in a straight line, $\beta_A=\beta_o$. At point B, steps 106 and 112 are repeated (assuming initially $\beta_B=\beta_A=\beta_o$) along with the remaining procedure of FIG. 3 in accordance with Configuration 1 to compute the new position of the boring tool and $\beta_B$ at point B. The assumption, in the present example, that the boring tool moves at one constant yaw angle during each of its incremental movements will be referred to as a level one approximation hereinafter. While this assumption actually holds true over the $\Delta L_l$ and $\Delta L_2$ increments, it does not hold true over the $\Delta L_3$ increment. During the latter movement, boring tool 26 initially moves between points B and D at $\beta_B=\beta_o$ until such time that it encounters boulder 14 at point C and is deflected to a yaw angle $\beta_C$. Thereafter, the boring tool proceeds to point D at its new yaw angle of $\beta_C$ which is then equal to $\beta_D$. One of skill in the art will appreciate that if the boring tool arrives at point D with a different β than that with which it started at point B, the tool could not have moved at one constant β between points B and D, as assumed in the level one approximation. Another alternative approach, which will be referred to as a level two approximation, considers these facts and will be described immediately hereinafter. At the same time, it is to be understood that the level one approximation will arrive at a solution with some error for the $\Delta L_3$ increment and, as to the position and $\beta$ of boring tool 26 at point D, by following the iterative procedure described thus far. This error is caused by the fact that the assumed path (with $\beta$ constant) is not the actual path.

The level two approximation is identical to the level one approximation, except for the assumptions regarding $\beta$. The level two approximation (still Configuration 1) assumes that the boring tool moves at a yaw angle $\beta_{AV}$ over a particular increment which is an average of the yaw angles at the beginning and end points of the increment. For purposes of brevity, the present approximation will immediately be described with reference to the $\Delta L_3$ increment. This increment, as described, starts with $\beta_B$ and ends with $\beta_D$. Equations 1 and 2 for this two dimensional example become:

$$\Delta x \sim \Delta L \cos \beta_{AV}, \text{ and} \tag{10}$$

$$\Delta y \sim \Delta L \sin \beta_{AV}, \text{ wherein} \tag{11}$$

$$\beta_{AV} = (\beta_{current} + \beta_{last})/2 \tag{12}$$

wherein $\Delta L = \Delta L_3$, $\beta_{last} = \beta_B$ and $\beta_{current} = \beta_D$ for $\Delta L_3$. The procedure of FIG. 3 remains unchanged for the level two approximation with one exception. Specifically, $\beta_{AV}$ is calculated using equation 12 and used in step 112 for integrating. Block 107 still calculates the current $\beta$ and solution procedure 118 still updates $\beta_{current}$. In integration solution step the mathematical effect of using $\beta_{AV}$ is essentially that of moving the boring tool to its new location over the entire length of the $\Delta L_3$ increment at $\beta_{AV}$, rather than $\beta_B$. This assumption is quite accurate as long as the increment $\Delta L$ is much less than the minimum bend radius of the drill pipe. The influence of the addition of z axis 37 and measurement of additional parameters will be considered in the discussion immediately following.

Figure 4:
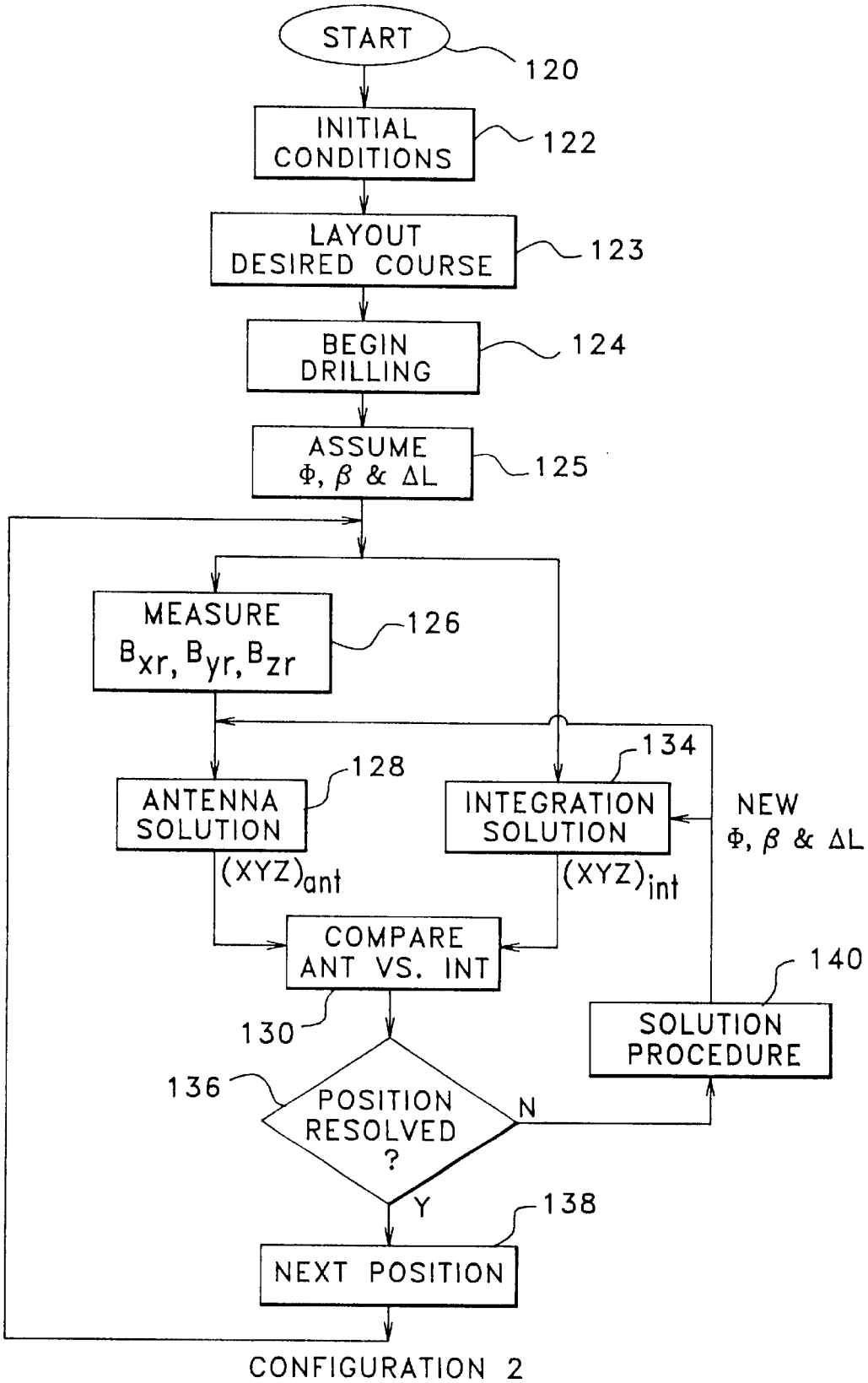
FIG. 4 is a flow diagram illustrating a procedure which considers locating the boring tool of FIGS. 1 and 2 in three dimensions while performing a horizontal boring operation by using three measured components of the magnetic locating signal emanated from the boring tool.

Referring to FIG. 4 in conjunction with FIGS. 1 through 3 and having described a two dimensional configuration for the reader's understanding, the addition of z axis 37 will first be considered. Table 1indicates a 3-dimensional embodiment of system 10 as Configuration 2 in which antenna cluster 65 measures $B_{xr}$, $B_{yr}$ and $B_{zr}$. Of course, addition of the z axis implies vertical movement and, consequently, pitch ($\phi$) of boring tool 26. One of skill in the art will recognize that the discussions above remain applicable in that the addition of the z axis simply comprises another axis along which the strength $B_{zr}$ of magnetic locating signal 60 may be measured at antenna cluster 65. The flow diagram of FIG. 4 illustrates Configuration 2 and includes $\phi$ and $B_z$ (in applicable steps) in a level one approximation for purposes of simplicity. One of skill in the art may readily adapt the present implementation to a level 2 approximation in view of the previous detailed discussion devoted to that subject. It should be noted that the logical and functional layout of the flow diagram of FIG. 4 is essentially identical with that of FIG. 3. Therefore, for purposes of brevity, descriptions of steps provided with regard to FIG. 3 will be relied on whenever possible and the present discussion will center upon those steps which are significantly affected by adding the z axis. The Configuration 2 procedure begins at start step 120 and moves to initial conditions step 122 which is performed similarly to previously described step 102. Additionally, step 122 must determine an initial $\phi$ ($\phi_o$) and an initial z value, which may be accomplished in the previously described setup technique by also measuring $B_{zr}$ at antenna cluster 65. At step 123, desired course of the boring tool may be entered into the system. Drilling proceeds at step 124.

Upon completion of first incremental movement $\Delta L_l$, the procedure moves to step 125 in which a value is assumed for $\Delta L_l$ along with the values of $\phi$ and $\beta$ established as initial conditions in step 122. In step 126, $B_{zr}$ is measured along with $B_{xr}$ and $B_{yr}$ at antenna cluster 65. The magnetic component measurements are provided along with $\phi_o$ and $\beta_o$ to antenna solution 128 which computes an $(xyz)_{ant}$ position based on these values, for example, by assuming that $\phi_o$ and $\beta_o$ have not changed over the movement and, thereafter, solving a set of equations based upon the pattern of dipole antenna 54 which emanates magnetic locating signal 60 in the now three dimensional master coordinate system. The $(xyz)_{ant}$ position is provided to compare step 130 which is similar to step 108, above, with the inclusion of the z values.

Concurrent with the path of steps 126 and 128, another path including step 134 is performed. $\Delta L_l$, $\phi_o$ and $\beta_o$ are passed to integration solution step 134, which is similar to previously described integration solution step 112, except that mathematical movement of boring tool 26 is now performed in a three dimensional space using the assumed $\phi$, $\beta$ and $\Delta L$. Integration solution step 134 outputs an $(xyz)_{int}$ position to compare step 130. The compare step determines the difference between the antenna and integration solutions and passes this difference to a position resolved decision step 136. If the difference is acceptable, step 138 returns the procedure to steps 125 for the next incremental movement. Otherwise, solution procedure step 140 is executed (similar in nature to previously described step 118). Using a known algorithm such as, for example, Simplex or steepest descent, solution procedure 118 provides new values for $\phi$, $\beta$ and $\Delta L$ which are assumed by the system and passed to steps 126 and 134 for use, as needed, in producing new $(xyz)_{ant}$ and $(xyz)_{int}$ positions. This loop continues until such time that step 136 is satisfied. It should also be mentioned that converting to a three dimensional positional system significantly increases the difficulties encountered in solving such a multi-variable problem as that which is presented by the present invention in the flow diagram of FIG. 4. Therefore, a highly advantageous approach will be presented immediately hereinafter which substantially reduces computational burdens placed on processor 50.

Figure 5:
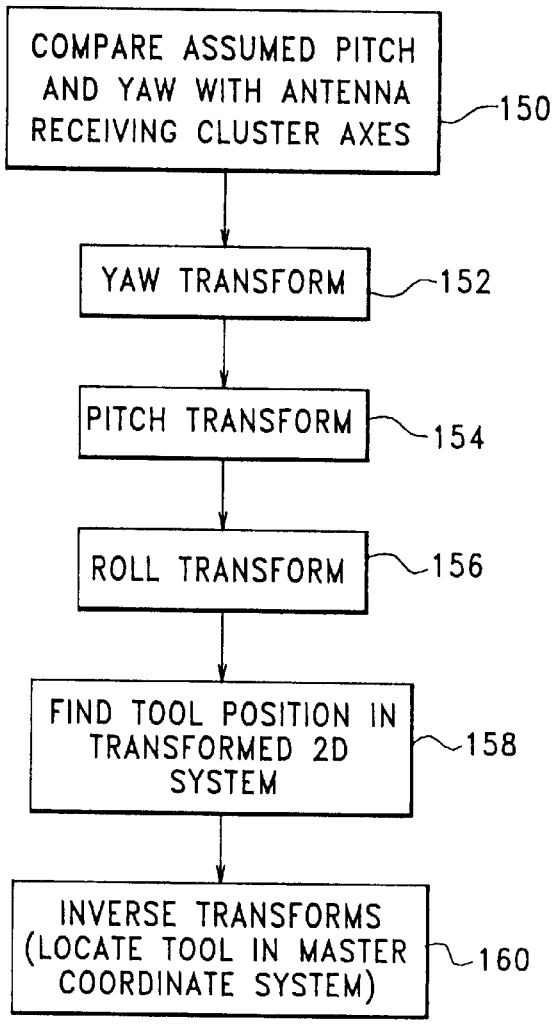
FIG. 5 is a flow diagram illustrating steps employed in an efficient triple transform technique for determining the position of the boring tool of FIGS. 1 and 2 in three dimensions in relation to an antenna cluster receiver by projecting components of the magnetic locating signal onto only two axes in a transformed coordinate system. These steps may be incorporated, for example, into the procedure of FIG. 4.

Referring to FIGS. 5 and 6*a–c* in conjunction with FIGS. 1 and 2, an exemplary dipole antenna 140 having an axis 142 within a boring tool (not shown for purposes of clarity) is illustrated at an orientation and position $x_d$, $y_d$ within the master coordinate system wherein $\phi \sim 20°$ and $\beta \sim 0°$. At point 66, where antenna cluster 65 is located, locating signal 60 from dipole 140 produces a three-dimensional flux vector B which is shown in relation to the reciving axes of the antenna cluster indicated as $x_r$, $y_r$ and $z_r$ with $x_r$ being oriented to due north and $z_r$ (FIG. 6*b*) being directed downward. One method of solving this three-dimensional problem is to mathematically re-orient the receiving axes of antenna cluster 65 to a new coordinate system that is aligned with dipole 140 in a specific way using the assumed values of $\beta$ and $\phi$ such that the problem is essentially reduced to two dimensions. To that end, the flow diagram of FIG. 5 illustrates steps which are incorporated into a three dimensional antenna solution such as, for example, antenna solution step 128 of FIG. 4, beginning with step 150. In step 150, the orientation of dipole 140 is compared with the assumed $\beta$ and $\phi$ values. Reorienting may then be accomplished, in view of this comparison, by using a series of three Euler transformations to create the new coordinate system in which magnetic locating signal 60 projects only onto two axes at antenna cluster receiver 65, as will be described immediately hereinafter.

Figure 6A:
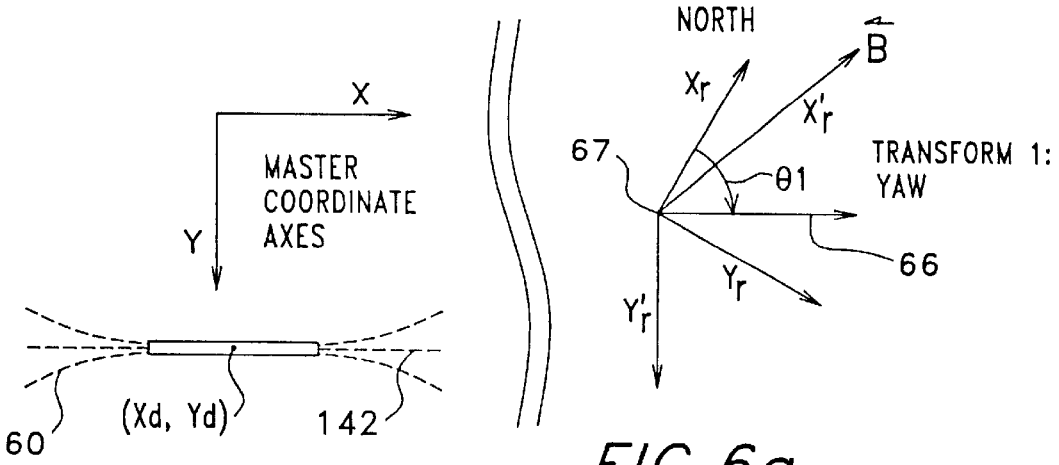
FIGS. 6*a–c* graphically illustrate yaw, pitch and roll transforms of the triple transform technique of FIG. 5, which are performed based on the orientation of the antenna cluster receiver in view of an assumed orientation of the dipole antenna from which the magnetic locating signal is transmitted, such that the desired two axis projection is accomplished.

Referring to FIGS. 5 and 6*a*, a yaw transform step 152 may be performed initially based on the assumed β. A yaw of an angle $\theta_1$ is performed about the z axis (perpendicular to the plane of the paper) which creates a new $x_r'$, $y_r'$ system such that $x_r'$ is parallel to the projection of dipole axis 142 onto the master xy coordinate system. In other words, the $x_r$ axis now has a β value which is equal to the assumed β.

Figure 6B:
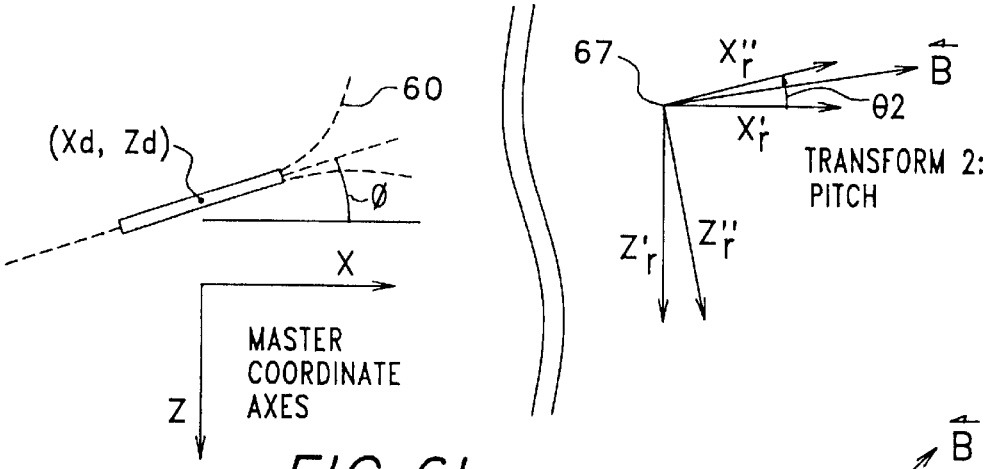

Turning to FIGS. 5 and 6*b*, step 154 performs a pitch transform. Dipole 140 is shown in the xz master coordinate plane such that the pitch, ϕ, of the dipole can be seen. In the pitch transform, the $x_r'$, $z_r'$ system ($z_r'=z_r$) is rotated by an angle $\theta_2$ about the $y_r'$ axis, which is now perpendicular to the plane of the paper. The effect of the pitch rotaion is to align a new $x_r''$, $z_r''$ system so that $x_r'$ is parallel with axis 142 of the dipole. In other words, the $x_r''$ axis now has a pitch which is equal to the assumed value for ϕ. Note that B continues to project onto three dimensions at the antenna cluster in this double prime system.

Figure 6C:
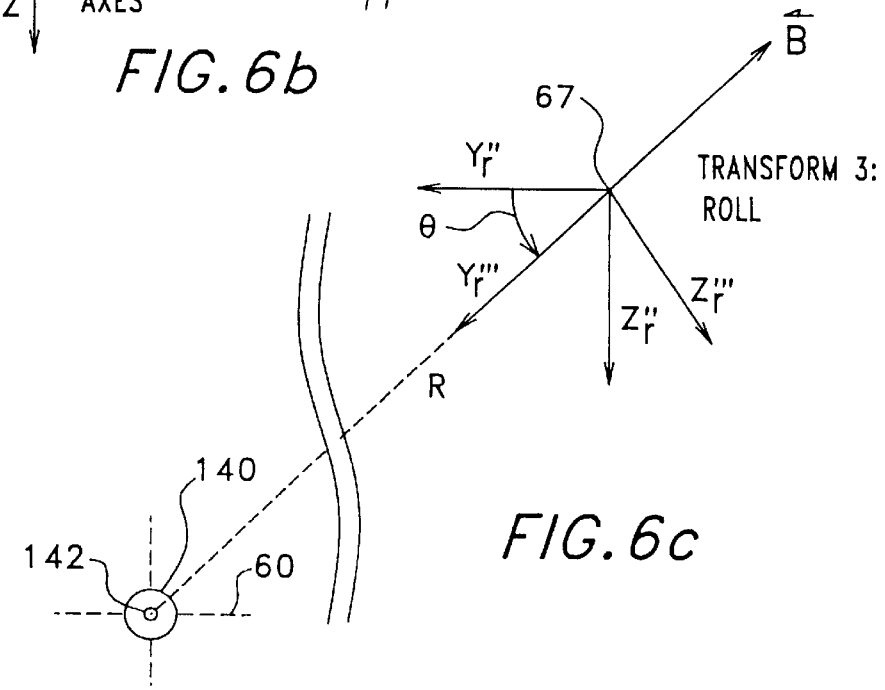

Step 156 then performs a third transform, illustrated in FIG. 6*c*, which is a roll about the $x_r''$ axis (which is perpendicular to the plane of the figure). In this transform, the $y_r''$ and $z_r'$ axes are rotated by an angle of $\theta_3$ to align a new $y_r'''$, $z_r'''$ system so that $y_r'''$ is aimed directly at axis 142 of the dipole. $\theta_3$ is selected so that $B_y'''$ will be zero. In this triple prime system, therefore, B projects onto $x_r'''$ ($=x_r''$) and $z_r'''$, but not onto $y_r'''$.

In step 158, a radius, R, and angle, θ, which specify the location of the dipole from the receiver, may be computed in the $x_r'''$, $z_r'''$ plane using the following relationships:

$$R^3 = \frac{1}{-\frac{B_{x'''}}{4} + \sqrt{\frac{9}{16} B_{x'''}^2 + \frac{1}{2} B_{z'''}^2}} \tag{13}$$

$$\theta = \tan^{-1} \frac{B_{z'''}}{B_{x'''} - \frac{2}{R^3}} \tag{14}$$

Thereafter, in step 160, the transforms of steps 156, 154 and 152 may be reversed to convert the transform variable location of the dipole back to a location in the master xyz coordinate system. The inventors of the present invention have discovered that proper implementation of the afore-described triple transform technique using assumed angles in an antenna solution for a three dimensional problem significantly reduces processing time as compared with implementations which attempt to locate the dipole directly in terms of the master coordinate system throughout the required processing.

Referring once again to FIGS. 1 and 2, system 10 may be configured to provide various inputs for use in determining the position of the boring tool, as noted previously. These inputs include directly measurable parameters such as, for example, ΔL, which may be measured at drill rig 18 by a measuring arrangement 170, and pitch which may be measured by a pitch sensor 174 positioned within drill head 26. One suitable pitch sensor is described in U.S. Pat. No. 5,337,002 which is issued to one of the inventors of the present invention and is incorporated herein by reference. A description of one highly advantageous embodiment of measuring arrangement 170 will be provided at an appropriate point hereinafter. At this juncture, it is sufficient to note that ΔL may be precisely measured to within a fraction of an inch by monitoring changes in the length of drill string 56 at drill rig 18. It should be appreciated that system 10 may utilize inputs such as ΔL and ϕ within the context of a number of different approaches in solving the problem of determining the position and orientation of boring tool 26. Two such approaches will be described hereinafter.

In the art, a system of equations for which the number of equations or known variables is equal to the number of unknown variables is referred to as being determinate while a system in which there are more known variables than unknowns is referred to as being over specified. A determinate system yields a solution set for its unknowns which precisely matches the specified parameters. However, due to possible inaccuracies introduced, for example, by the equations themselves in matching the actual physical system being mathematically represented and measurement inaccuracies, a determinate solution can be highly sensitive to errors in the specified parameters. One method of reducing such sensitivity is to form an over specified solution in which the number of equations or known variables is greater than the number of unknowns. In this latter case, according to a first approach, a least square error technique may be employed to arrive at an overall solution in which measured values of ΔL and/or ϕ may be used in conjunction with measurements of magnetic locating field 60 ($B_{xr}$, $B_{yr}$ and $B_{zr}$)to formulate a solution for determining the position of the boring tool with a high degree of accuracy.

Figure 7:
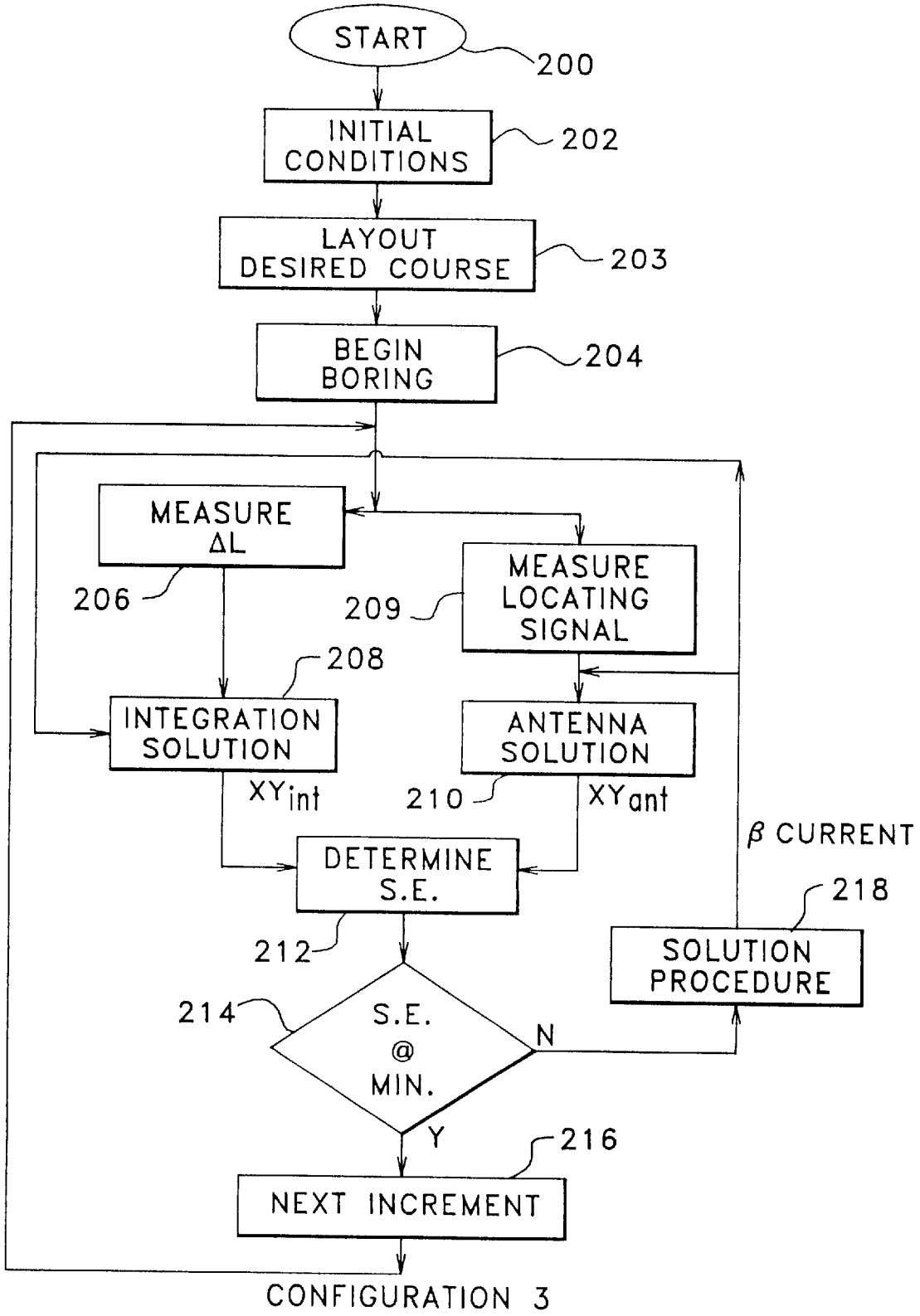
FIG. 7 is a flow diagram illustrating the steps of an exemplary, planar procedure for determining the position of the boring tool of FIGS. 1 and 2 in two dimensions by using a measured incremental movement in conjunction with two measured components of the magnetic locating signal wherein a least square error approach is used to compare an antenna solution with an integration solution.

Referring now to FIGS. 1, 2 and 7, one implementation of the Least Square Error (LSE) approach is indicated as Configuration 3 in Table 1. Like much of the preceding discussion with regard to FIGS. 1 and 2, the present discussion will be limited to the xy master coordinate system, ignoring the z axis for purposes of simplicity. Furthermore, the present discussion will address the LSE approach in a manner which is consistent with the previously described level two approximation (that is, use an average value for β). One of skill in the art will readily adapt the present discussion to the first order approximation which was also described previously. A start step 200 begins the flow diagram of FIG. 7 and leads immediately to steps 202 and 203 in which initial conditions are established and the desired tool course may be entered, as described above with regard to FIGS. 1 and 2. At step 204, the boring operation begins. Thereafter, at step 206, ΔL is physically measured at the drill rig for a just completed incremental movement of boring tool 26. ΔL is then provided to an integration solution step 208. An assumed $\beta_{current}$ is then used with ΔL in equations 9 and 10, above, to compute Δx and Δy. Initially for each increment, the assumed $\beta_{AV}$ may be made equal to the last known β. For example, at point A, $\beta_{AV}$ may be set to the value $\beta_o$, established in initial conditions step 202, whereas at point B, $\beta_{AV}$ may initially be set to the final value, $\beta_A$, previously established for point A. An $(xy)_{int}$ position is then calculated by the integration solution, using $\beta_{AV}$ and ΔL, for use in step 212, which will be described below.

Concurrently with steps 206 and 208, step 209 may be performed. In step 209, components $B_{xr}$ and $B_{yr}$ of magnetic locating signal 60 are measured by antenna cluster receiver 65 and provided to an antenna solution step 210 along with the assumed $\beta_{current}$. Based on these values, antenna solution step 210 calculates an $(xy)_{ant}$ position for boring tool 26 and provides this position to step 212. The latter step determines the square error (SE) based on the step 208 integration solution and the step 210 antenna solution using:

$$SE=(x_{int}-x_{ant})^2+(y_{int}-y_{ant})^2 \tag{15}$$

The square error can also be formulated in terms of $B_{xr}$ and $B_{yr}$ as will be discussed later in the specification. Step 214 is then performed so as to determine if the value of SE is at its minimum value, indicating that the antenna and integration solutions have been converged to the greatest extent possible. Of course, this function cannot be performed until such time as at least one value of SE has previously been computed and stored following the start of a boring operation, for example, after $\Delta L_l$. If the SE is at a minimum, step 216 is entered wherein the system readies for the next incremental movement and the associated $\beta_{current}$ value is used in equation 12 to determine the current yaw. Otherwise, step 218 is next performed in which a solution procedure picks a new value for $\beta_{current}$ which is intended to reduce the square error. As previously described, a number of techniques are available in the art for converging solutions to problems such as picking the new value of $\beta_{current}$. In the present example, the Simplex technique is utilized. The new $\beta_{current}$ is returned to step 208 to compute a new $(xy)_{int}$. Antenna solution step 210 is provided with $\beta_{current}$ such that the antenna solution may be re-calculated to provide a new $(xy)_{ant}$ value. Therefore, each new value of $\beta_{current}$ produces new values for $(xy)_{int}$ and for $(xy)_{ant}$ which, in turn, produce a new square error value in step 212. Iteration of $\beta_{current}$ values is repeated until the square error value from equation 15 is minimized i.e. least square error. The solution for $(x,y,z)_{sonde}$ can be based on either the antenna result, the integration result or an average of the two. If the solution is properly converged and measurement errors are negligible then all the results would agree, i.e. zero square error. It should be mentioned that a measured $\phi$ value may also be incorporated in an LSE solution for a configuration in which three dimensions are considered, as will be discussed below.

Figure 8:
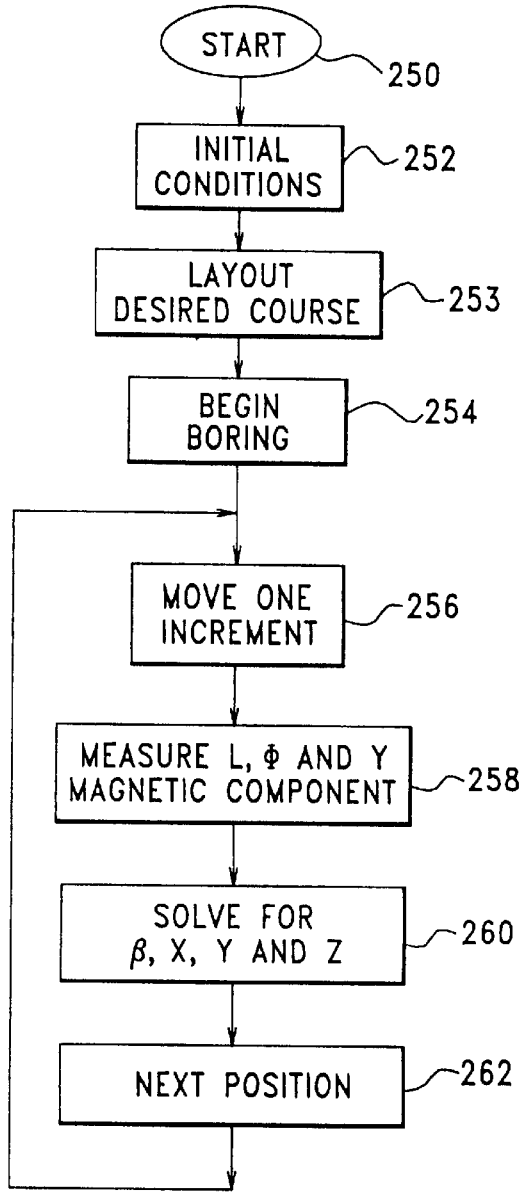
FIG. 8 is a flow diagram illustrating the steps of a procedure for locating the boring tool of FIGS. 1 and 2 in three dimensions using a measured incremental movement and a measured pitch in conjunction with a single, measured component of the magnetic locating signal.

As a second approach, measured inputs such as $\Delta L$ and $\phi$ may be used in a way which may reduce the overall complexity and cost of system 10 while still maintaining a high degree of accuracy in determining the position of boring tool 26 during the drilling operation. The flow diagram of FIG. 8 illustrates another two dimensional implementation of system 10 which is referred to as Configuration 4 and is listed in Table 1. In this configuration, $\Delta L$ and $\phi$ are measured and used in a level 1 approximation along with $B_{yr}$. In order to further enhance the reader's understanding, it is suggested that the process of FIG. 8 may be directly compared with that of FIG. 4, illustrating Configuration 2, which is also three dimensional but differs in that all three magnetic locating field axes are measured and are the sole inputs used in determining the location of the boring tool. Following a start step 250, initial conditions are established in step 252, for example, in the manner previously described. In step 253, a desired course for the boring tool may be entered at operator console 44, for example, using data gathered by surveying techniques. As noted, an exemplary desired tool course display will be provided at an appropriate point below. The drilling operation begins at step 254 and one incremental movement of boring tool 26 is completed in step 256. In step 258, $\Delta L$ and y component, $B_{yr}$, of magnetic locating signal 60 is measured by antenna cluster receiver 65. Calculations are then performed by step 260 to determine the new xy position of the boring tool and $\beta$ based upon its last known position in conjunction with the measured values of $\Delta L$, $\phi$ and the one measured component of magnetic locating signal 60. Since $\Delta L$, $\phi$ and the last $\beta$ are known and assuming the tool has traveled in the direction in which it is pointed at one yaw angle (the last $\beta$) in accordance with the level one approximation, the $\Delta x$, $\Delta y$ and $\Delta z$ increments for a particular incremental movement may readily be determined using the equations:

$$\Delta x = \Delta L \cos\phi \cos\beta, \tag{16}$$

$$\Delta y = \Delta L \cos\phi \sin\beta, \text{ and} \tag{17}$$

$$\Delta z = -\Delta L \sin\phi \tag{18}$$

The $\Delta x$, $\Delta y$ and $\Delta z$ components may then simply be added to the last known x, y and z coordinates so as to determine the new position of the boring tool within the master coordinate system. $\beta$, at the new position, may then be established using the measured component $B_{xr}$ or $B_{yr}$ of the intensity of the magnetic locating signal. In this instance, the use of only one magnetic intensity reading yields a solution for $\beta$ which is determinate, based on known equations for a dipole antenna pattern. It should be noted that $B_{xr}$ or $B_{yr}$ are favored over the use of $B_{zr}$ simply because the former are most sensitive to yaw over most of the bore length. Following step 260, the system readies for the next incremental movement by updating the boring tool position and then returning to step 256 from step 262.

In addition to reduced componentry because antenna cluster 65 need only measure along one antenna axis, it should also be mentioned that Configuration 4, under the flow diagram of FIG. 8, is advantageous in that processing power which must be brought to bear on its calculations is held to a minimum level. The steps in FIG. 8, unlike those of FIG. 4, are not iterative for respective $\Delta L$ movements, whereby to further simplify the calculation procedure. The level 1 approximation can be raised to a level 2 approximation by incorporating an iterative process into step 260. An average $\beta$ can be used to compute the new x, y, and z positions which, in turn, would produce a new $\beta_{current}$. The iteration would continue until $\beta_{current}$ converged.

As described above, Configuration 2 embodies a determinate system with a total reliance on magnetic locating field measurements while Configuration 4 embodies a determinate system using a cost effective approach in which only one magnetic measurement is made. With reference to Table 1and FIGS. 1 and 2, a number of other configurations of system 10, may also be found to be useful based upon specific objectives. One such objective may be to assure the reliability of the calculated position of boring tool 26 by overspecifying to the greatest possible extent. For example, Configuration 5 is an embodiment of system 10 which is similar to Configuration 2 except that $\Delta L$ and $\phi$ are both measured using measuring arrangement 170 and pitch sensor 174, respectively. It should be appreciated that Configuration 5 may implement an LSE approach which is over specified by two additional variables. The accuracy of the measurable parameters, as well as when the measurements are available should also be considered. These considerations are applicable with regard to pitch sensor 174. Specifically, pitch sensors are subject to producing errors in readings due to rotation and rotation accelerations of boring tool 26 during drilling due to splashing of fluid (not shown) internal to the pitch sensor. For this reason, Configuration 5 may be implemented in an alternative way by using pitch sensor readings only when the boring tool is stationary as a cross-check mode to intermittently verify the accuracy of current calculations. In this alternative implementation, the $\Delta L$ measurement may, of course, continue to be used as part of an LSE approach. It should also be appreciated that a cross-check mode may also be utilized with regard to $\Delta L$ wherein a calculated value of $\Delta L$ can be compared with a measured $\Delta L$ value whereby to verify accuracy of current positional computations. It is to be understood that such a cross-check mode may be implemented with any embodiment of the present invention disclosed herein.

Configuration 6 in Table 1 illustrates an approach wherein pitch is calculated, rather than using a pitch sensor or the cross-check mode above. The objective of this configuration is simply that of avoiding any need to rely on a pitch sensor. It is to be understood that the configurations shown in Table 1 and described herein are not intended to be limiting but are intended to illustrate at least a few of the broad array of variations in which system 10 may be configured in accordance with the present invention.

It is worthy of mention that signal strength, S, is specified as a measured value for each of the configurations listed in Table 1. In view of the stability and reliability of state of the art transmitters of the type which may be used to transmit magnetic locating signal 60, a constant output value for S may readily be achieved and may be measured for a particular transmitter prior to beginning a boring run, as described previously. However, other configurations may also be used in which the value of S is calculated as an unknown variable. For example, Configurations 5 or 6 may be modified such that S is a calculated variable. This configuration may be useful, for example, in cases where transmitter strength may vary due to battery fatigue in a long drill run or when an operation extends over more than one day such that the transmitter operates through the night, even though the system is idle. The calculated value of scan can also be used, as ΔL was used, to verify the accuracy of the calculations.

Another feature which can be added to the L.S.E. analysis is a set of weighting functions which are well known in the art. Weighting functions can be applied to the square error parameters (x, y, and z) to reduce sensitivity to error in measurements. For example, if the z position was found to be very sensitive to the z component of the magnetic field measurement $B_z$ and the $B_z$ measurement had poor accuracy because it was close to the background noise level, a weighting function could be used to minimize the influence of z error on the square error. The resulting solution with functions would be more accurate than the solution without weighting functions. A system of weighting functions could be applied to all of the square error parameters based on the sensitivity of each parameter to measurement error and an estimate of the measurement error such as the noise to signal ratio.

Figure 9A:
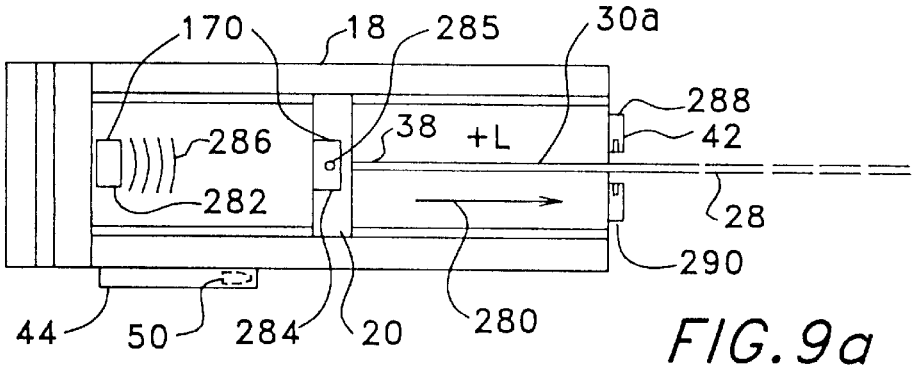
FIGS. 9*a–d* are diagrammatic plan views of the drill rig and drill string initially shown in FIGS. 1 and 2 which are shown here to illustrate the operation of a measuring arrangement, which is manufactured in accordance with the present invention, for determining incremental movements of the drill string.

Turning now to FIG. 1. FIGS. 9*a–d* and FIG. 10, a description of previously mentioned measuring arrangement 170, manufactured in accordance with the present invention, will now be described in detail in relation to the operation of the drill rig. The reader will recall that upper end 38 of drill pipe section 30*a* is held by a chuck or screw arrangement which forms part of carriage 20. As carriage 20 moves in a +L direction which is indicated by an arrow 280, drill string 28 is pushed into the ground by the fact that it is attached to drill pipe section 30*a*. Measuring arrangement 170 includes a stationary ultrasonic transmitter 282 positioned on drill frame 18 and an ultrasonic receiver 284 with an air temperature sensor 285 positioned on carriage 20. It should be noted that the positions of the ultrasonic transmitter and receiver may be interchanged with no effect on measurement capabilities. Transmitter 282 and receiver 284 are each coupled to processor 50 or a separate dedicated processor (not shown). In a manner which is well known in the art, transmitter 282 emits an ultrasonic wave 286 that is picked up at receiver 284 such that the distance between the receiver and the transmitter may be determined to within a fraction of an inch by processor 50 using time delay and temperature measurements. By monitoring movements of carriage 20 in which drill string 28 is either pushed into or pulled out of the ground and clamping arrangement 42, processor 50 may accurately track the length of drill string 28 throughout a drilling operation. The clamping arrangement includes first and second halves 288 and 290, respectively, which engage drill string 28 in a clamped position (FIG. 9*b*) and which permit the drill string to move laterally and/or rotate in an unclamped position (FIG. 9*a*). The clamping arrangement is used to hold drill string 28 while adding or removing additional lengths of drill pipe 30*a*.

Figure 10:
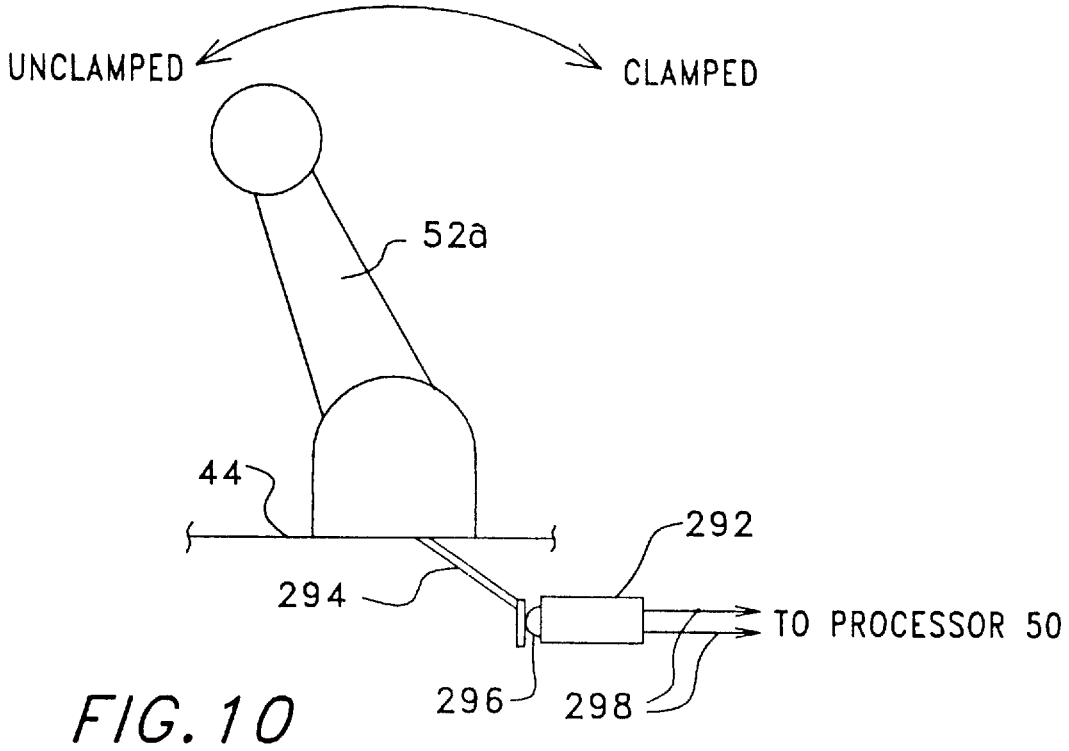
FIG. 10 is a diagrammatic elevational view illustrating one arrangement for determining the status of a clamping arrangement initially shown in FIGS. 1 and 2.

Turning to FIG. 10, monitoring of the clamping arrangement is accomplished using a cooperating micro-switch 292 which is mounted within operator console 44 adjacent clamping arrangement control lever 52*a*. When the latter is in the unclamped position, an actuator arm 294, which moves in corresponding relationship with the lever, engages an actuator pin 296 whereby to close a set of contacts (not shown) within micro-switch 292 that are connected to processor 50 by conductors 298. It is to be understood that the use of micro-switch 292 is only one of many ways in which the status of clamping arrangement 42 may be monitored by processor 52. A device (not shown) other than a micro-switch may also serve in this application. For example, an infrared diode and phototransistor pair may be positioned so as to monitor the status of lever 52*a*. Another useful device could be a pressure switch, since clamp 42 is generally operated by hydraulic pressure. Still another device which may be used is a Hall effect sensor. The latter is advantageous in that it is completely sealed from the elements.

Referring again to FIGS. 9*a–d* and 10, it will be appreciated that the length of drill string 28 in the ground can change only when processor 50 receives the unclamped indication since it is only then that the drill string can be moved laterally by carriage 20. With regard to the movement of carriage 20 illustrated in FIG. 9*a*, processor 50 detects that clamping arrangement 42 is in its unclamped position using micro-switch 292 and increments the length of the drill string by a length corresponding to the detected change in distance between the ultrasonic receiver/transmitter pair. Additionally, processor 50 tracks incremental positions along the drill string (corresponding to points A–D in region 12 of FIGS. 1 and 2) at which positional information is measured and/or calculated.

Figure 9B:
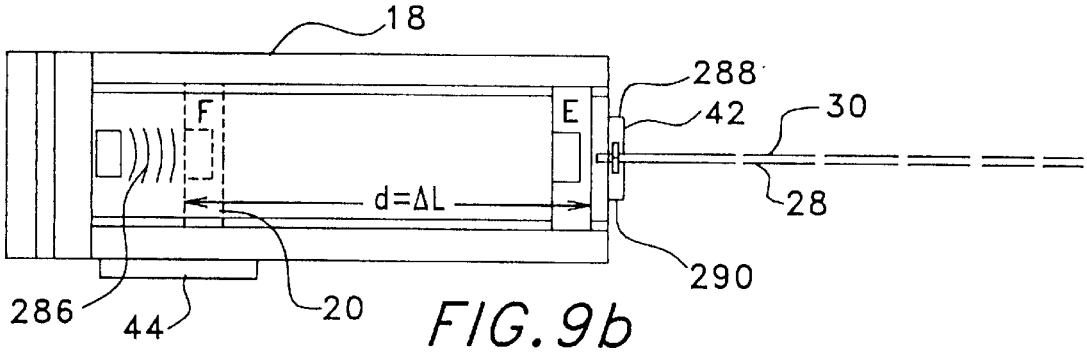

In FIG. 9*b*, carriage 20 has moved as far as possible on the drill rig in the +L direction to a position E and then the clamping arrangement is moved to its clamped position. Assuming that the carriage started at a position F, the drill string is lengthened by a distance d for this movement, as indicated by measuring arrangement 170. During normal drilling, a new section of drill pipe must be added to the drill string once the carriage reaches position E. As a matter of opportunity, system 10 may perform positional calculations when a drill pipe section is added to drill string 28. Therefore, ΔL will be approximately equal to the length of a drill pipe section or d in the present example.

Figure 9C:
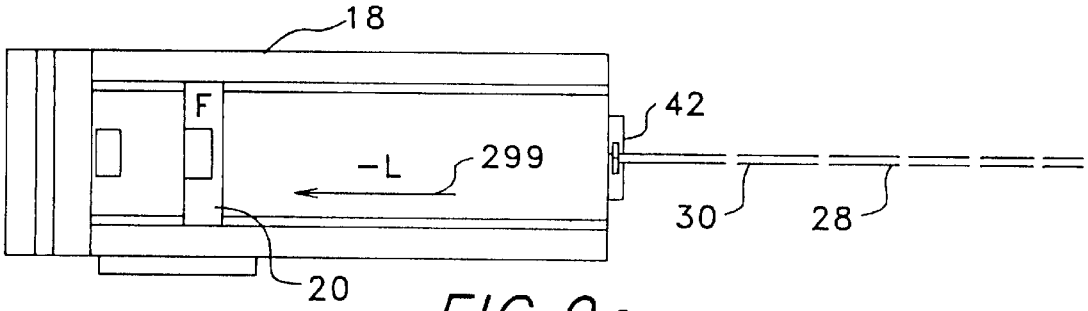

Referring now to FIG. 9*c*, carriage 20 must first be translated back to position F in the−L direction, indicated by an arrow 299, in order to be connected with a new section of drill pipe. During this−L translation, however, clamping arrangement 42 is in its clamped position in order to prevent any movement of the drill string and to support the drill string while the new drill pipe section is being attached since the drill string is no longer under the control of carriage 20. Processor 50 detects the clamped status of the clamping arrangement and, thereafter, ignores the translational movement as having no effect on the length of the drill string. From position F and after connection to a new drill pipe section, the carriage may once again move in the−L direction to position E whereby to continue drilling, as in FIG. 9*a*.

Figure 9D:
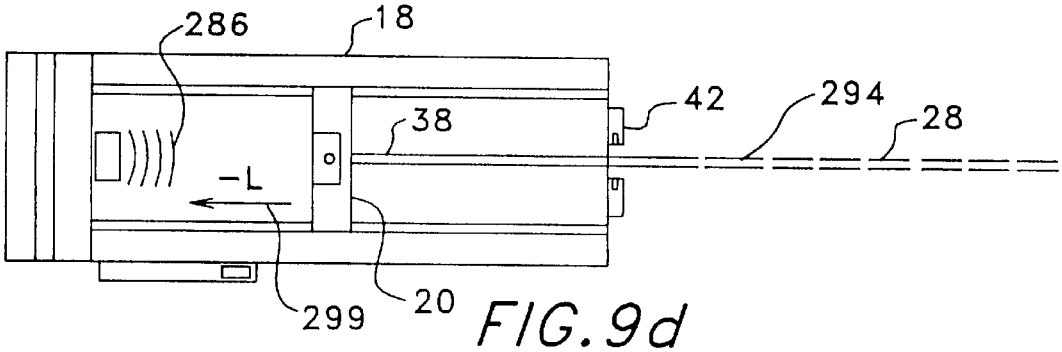

FIG. 9*d* illustrates the situation encountered when drill string 28 is being retracted from the ground in the −L direction. Because clamping arrangement 42 is in its opened position, this movement affects the length of the drill string and is used by processor 50 as decrementing the overall length of the drill string. Such a situation may be encountered, for example, if the boring tool hits some sort of underground obstruction such as boulder 14 (FIG. 1). In this case, it is common practice for the operator of the drill rig to alternately retract and push the drill string in an attempt to break through or dislodge the obstruction. Drill string measuring arrangement 170 advantageously accounts for each of these movements since clamping arrangement 42 remains in its open position. Another significant advantage of measuring arrangement 170 resides in the fact that ultrasonic receiver/transmitter pair 282/284 and microswitch 292 are positioned on the drill rig away from an area 294 where the drill string actually enters the ground. In area 294, work is sometimes performed on the drill string using heavy tools which might easily damage an electronic or electrical component positioned in close proximity thereto. Additionally, drilling mud (not shown) is normally injected down the drill string to aid in the drilling process. This mud then flows out of the bore where the drill string enters the ground creating still another hazard for sensitive components placed nearby. It is to be understood that measuring arrangement 170 may be configured in any number of alternative ways within the scope of the present invention so long as accurate tracking of the drill string length is facilitated.

Turning once again to FIGS. 1 and 2, antenna cluster receiver 65 has been described previously as being configured for measuring components of magnetic locating signal 60 along one or more axes as defined, for example, by antenna structure 67. In cases where two or more axes are used, they are orthogonally disposed to one another. In such antenna arrangements particularly, for example, when two or more dipole antennas are used, it is quite difficult to precisely establish the origin of the dipole array. Therefore, the present invention provides a highly advantageous antenna which is suitable for use as antenna structure 67 within any previously described embodiment of the system of the present invention and which is specifically configured for precisely establishing the origin of its magnetic field, regardless of the number of receiving axes, as will be described immediately hereinafter.

Figure 11:
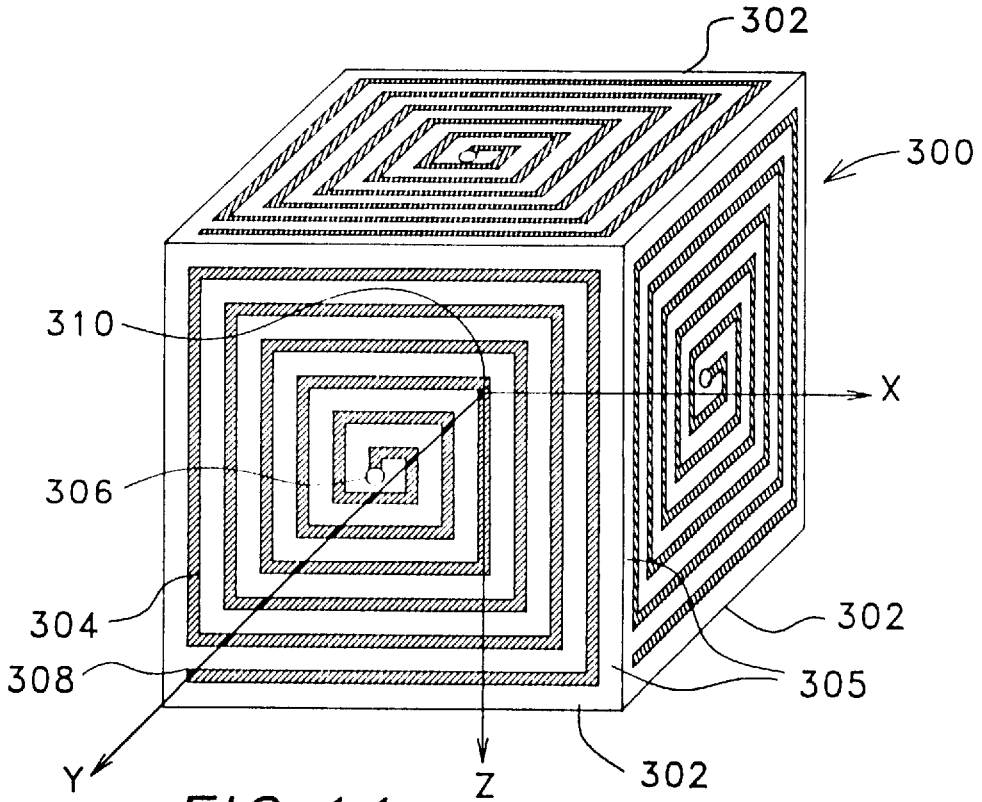
FIG. 11 is a perspective view of a cubic antenna manufactured in accordance with the present invention.

Referring to FIG. 11 a cubic antenna configured for use in the antenna cluster receiver of the present invention is generally indicated by the reference numeral 300. Cubic antenna 300, is configured for reception along orthogonally disposed x, y and z axes. The antenna is comprised of six essentially identical printed circuit boards 302 (only 3 of which are visible in FIG. 10) which are arranged in three pairs of two along each axis and are physically attached to one another, for example, by non-conductive epoxy (not shown) so as not to affect the antenna pattern while cooperatively defining a cube. An or tho-rectangular spiral conductive pattern 304 is formed on one side 305 of each board with the same pattern being formed on its opposing side, although the opposing side pattern is not visible in the present figure, such that these sides are interchangeable. A via 306 electrically interconnects the opposing patterns. In this way, the voltage induced in each pattern by a changing magnetic field is such that the voltages are additive. A pair of boards 302, arranged along a particular axis, are electrically interconnected by simply interconnecting ends 308 of confronting patterns 304 to one another such that the voltages are additive (i.e. all patterns spiral around their axis in the same relative direction). It should be appreciated that cubic antenna 300 produces an antenna pattern having a center 310 which is located precisely at the intersection of its x, y and z axes. Therefore, cubic antenna 300 may be positioned in a particular application such that the location of center 310 of its antenna pattern is precisely known. The cubic antenna is particularly useful herein since the present invention contemplates highly accurate locating/steering capabilities which have not been seen heretofore. Thus, the introduction of one possible error in measurement resolution is eliminated by the fact that the location of the origin of the antenna pattern is precisely known. Also, the signal produced by averaging the confronting side (i.e. circuit boards 302) signals will produce a value very close to the actual value at the center of the cube. For example, if the transmitter were seven feet away from a six inch cube, the error produced using one side of the cube to approximate the signal strength is about ten times larger than the error produced by summing the signals produced by the confronting boards and dividing by two.

Continuing to refer to FIG. 11, the principles of the cubic antenna are readily applied to a single antenna or to a two antenna array by simply eliminating the foil patterns along one or two axes, respectively, such that the pc boards on the unused axes are blank and merely serve as dielectric supports for the pc boards which do support foil patterns whereby to keep the antenna pattern precisely centered. Using construction techniques developed for printed circuit board manufacturing to produce boards 302 ensures accurate as well as economical manufacture of the cubic antenna. It should also be mentioned that the cubic antenna possesses equal efficacy in transmission applications and that its use is not intended to be limited to that of a boring tool locating/guidance system, but extends to any application which may benefit from its disclosed characteristics. Additionally, the cubic antenna may be implemented in any number of alternative ways (not shown) within the scope of the present invention, for example, using wire coils supported on a frame structure rather than pc boards. The wire coils could be either air core or wound on a ferromagnetic rod. Also, electric field shielding could easily be added to the pc board arrangement by fabricating another layer with a radial pattern that does not have closed loops which could shield the magnetic field.

Figure 12:
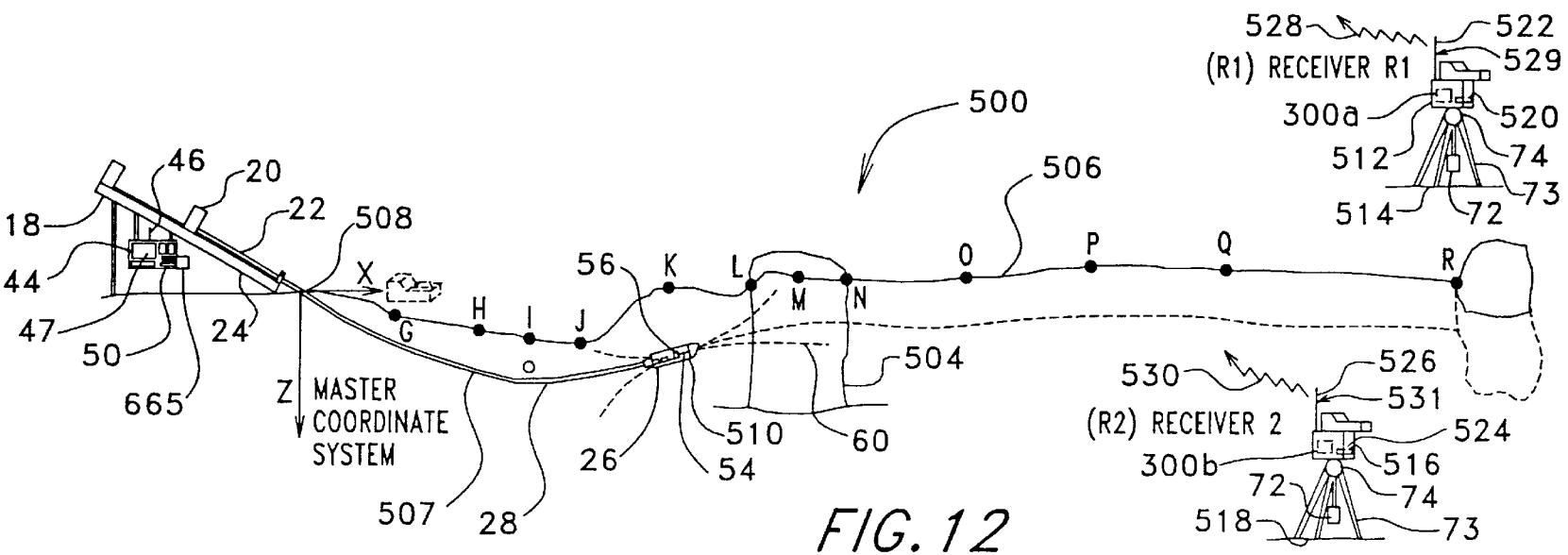
FIG. 12 is a diagrammatic elevational view of a horizontal boring operation being performed in a region using another horizontal boring tool system manufactured in accordance with the present invention.
Figure 13:
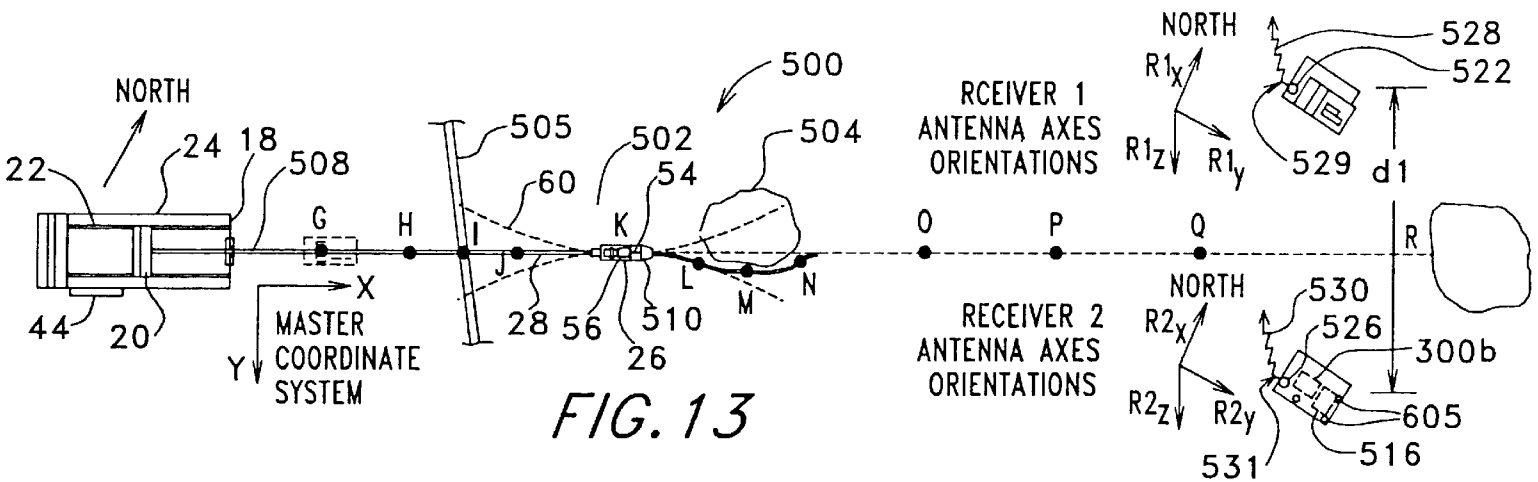
FIG. 13 is a diagrammatic plan view of the region of FIG. 12 further illustrating aspects of the horizontal boring operation being performed.

Attention is now directed to FIGS. 12 and 13 which illustrate a horizontal boring operation being performed using another boring/drilling system which is manufactured in accordance with the present invention and generally indicated by the reference numeral 500. To the extent that system 500 includes certain components which may be identical to previously described components of system 10, like reference numbers will be applied wherever possible and associated descriptions will not be repeated for purposes of brevity. The drilling operation is performed in a region of ground 502 including a boulder 504 and an underground conduit 505. The surface of the ground is indicated by reference numeral 506.

System 500 includes previously described drill rig 18 along with carriage 20 received on rails 22 which a mounted on frame 24. Boring tool 26 is attached to drill string 28, as before. The underground progression of boring tool 26 is indicated in a series of points G through R which will be considered as defining an exemplary mapped boring tool path 507 which will be used with reference to a number of systems disclosed herein. As noted above, data from which the mapped/desired boring tool path is plotted may be gained using surveying techniques. However, these data may be provided in other ways, as will be seen below. The present example considers movement of boring tool 26 in a master xyz coordinate system wherein x extends forward from the drill rig, y extends to the right when facing in the positive x direction and z is directed downward into the ground. The origin of the xyz master coordinate system is specified by reference numeral 508 at the point where the boring tool enters the ground.

Boring tool 26 includes dipole antenna 54 which is driven by transmitter 56 so that magnetic locating signal 60 is emanated from antenna 54. With regard to system 500, antenna 54 in combination with transmitter 56 will be referred to as sonde 510. In accordance with the present invention, a first antenna cluster receiver 512 (hereinafter receiver 1 or R1) is positioned at a point 514 within the master xyz coordinate system while a second antenna cluster receiver 516 (hereinafter receiver 2 or R2) is positioned at a point 518. Appropriate positioning of the receivers will be described at an appropriate point below.

Receivers 1 and 2 each pick up magnetic locating signal 60 from sonde 510 using cubic antennas 300*a* and 300*b* (identical to previously described cubic antenna 300 of FIG. 11), respectively, such that each receiver may detect signal 60 along three orthogonally disposed receiving axes which are indicated in FIG. 13 as $R1_x$, $R1_y$, $R1_z$ for receiver 1 and $R2_x$, $R2_y$, $R2_z$ for receiver 2. Receivers 1 and 2 are also used to record noise contamination of the surround temporarily turning off magnetic locating signal 60. Components of locating signal 60, as measured along any of these axes are denoted by preceding the subscripted name of the axis with a "B", for example, $BR1_x$. Receiver R1 includes a telemetry transmitter 520 and a telemetry antenna 522, while receiver R2 includes a telemetry transmitter 524 and a telemetry antenna 526. Magnetic information for R1 is encoded and transmitted as a telemetry signal 528 from telemetry antenna 522 to operator console 44. At the operator console, antenna 46 receives telemetry signal 528 which is then provided to processor 50. Telemetry transmitter 520, antenna 522 and signal 528 will hereinafter be referred to as a telemetry link 529. Magnetic information for R2 is similarly encoded and transmitted as a telemetry signal 530 from telemetry antenna 524 to operator console 44 for subsequent processing by processor 50. Telemetry transmitter 524, antenna 526 and signal 530 will hereinafter be referred to as a telemetry link 531. The telemetry information from each of the receivers is used to determine the position and orientation of sonde 510, and thereby boring tool 26, in a highly advantageous way, as will be described hereinafter.

Still referring to FIGS. 12 and 13, the initial drilling array layout must be established such that information derived from magnetic locating signal 60, during the drilling process, is meaningful. Information which is of interest as initial conditions includes: (1) the transmitted strength of magnetic locating signal 60, (2) an initial yaw and pitch of sonde 510 in the master coordinate system (measured from the master x and z axes, respectively), (3) the coordinates of R1 and R2 within the master xyz coordinate system, and (4) the orientations of the R1 and R2 receiving axes. Not all initial conditions are necessary, for example, initial condition 2 is not needed if initial condition 3 is known. As is the case with system 10, the array layout and initial conditions may be established in any number of different ways. In one such way, receivers 1 and 2 are spaced apart such that a path between the receivers perpendicularly intersects the desired path of the boring tool and the receivers are separated by a distance dl bisected by the intended tool path. As will be described below, a specific relationship may be maintained between the length of the drill path and distance dl.

One method (not shown) of establishing the initial drilling array setup is through directly measuring the positions of R1 and R2 using surveying techniques. The receiving axes of each receiver may be oriented such that $R1_x$ and $R2_x$ are aimed in a direction (not shown) which is perpendicular to the desired path of the boring tool. Receivers 1 and 2 may also incorporate gimbal 72 and counterweight 74, described previously with regard to FIG. 2, such that the cubic antenna within each receiver is maintained in a level orientation. Another method is to transmit from the boring tool transmitter at a known position, such as the starting point, and calculate the R1 and R2 positions using the same process as in FIG. 16. As will be seen immediately hereinafter, the present invention provides a highly advantageous instrument and associated method for establishing the initial array orientation and for carrying forth the drilling operation along mapped path 507, which may be established using the aforementioned instrument, with an accuracy and ease which has not been seen heretofore. This instrument is referred to herein as a "mapping tool" and will be described in detail immediately hereinafter.

Figure 14:
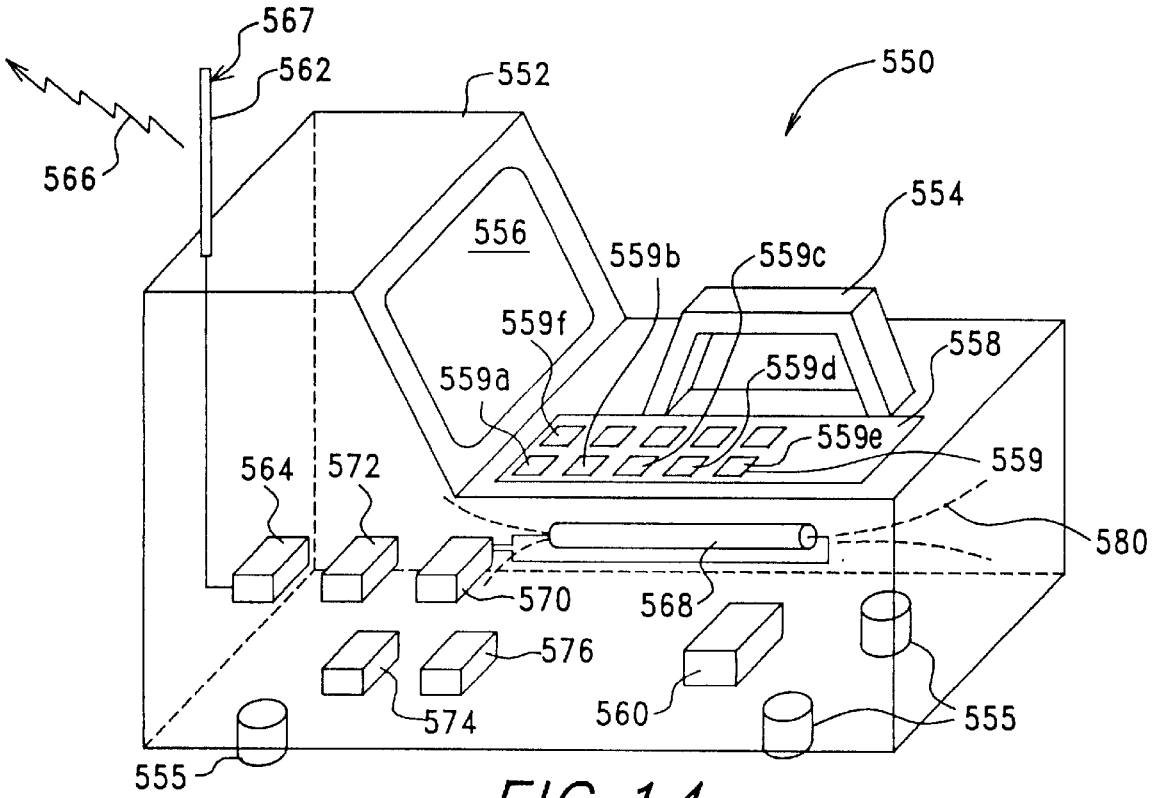
FIG. 14 is a diagrammatic perspective view of a mapping tool which is manufactured in accordance with the present invention.
Figure 15:
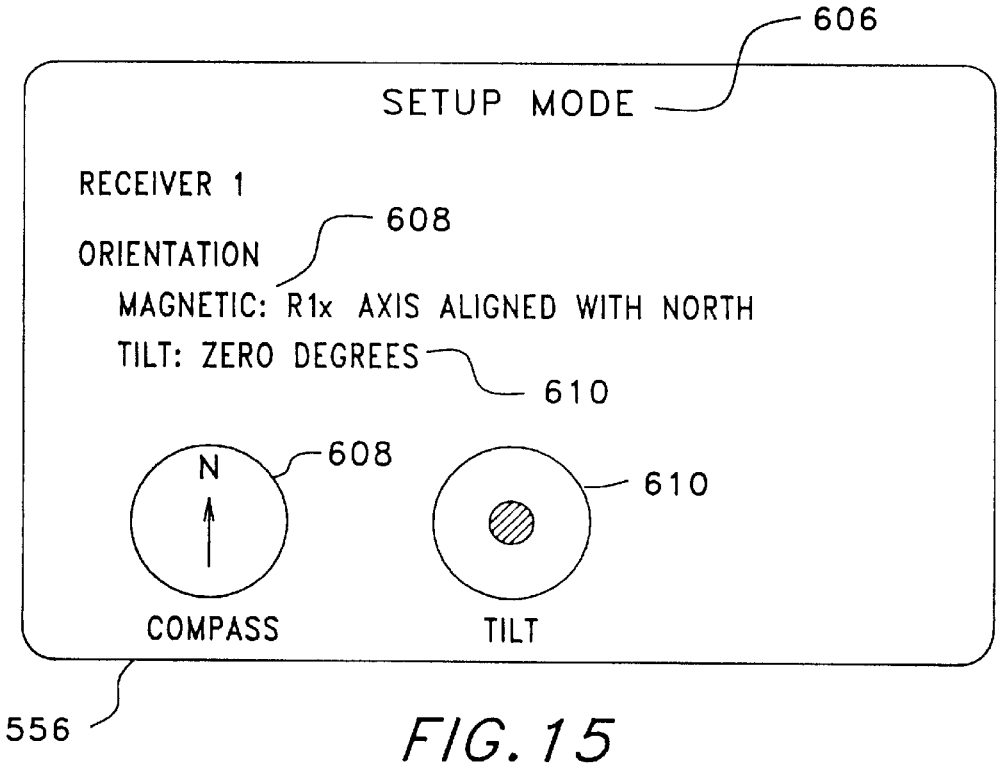
FIG. 15 is an illustration of one way in which a display screen of the mapping tool of FIG. 14 might appear in a setup mode.

Referring now to FIG. 14, a mapping tool is generally indicated by the reference numeral 550. Mapping tool 550 is portable and includes a case 552 having a handle 554 and indexing pins 555 on the bottom of the case. A display panel 556 is positioned for ease of viewing and a keyboard panel 558 having a series of buttons 559 provides for entry necessary data. Power is provided by a battery 560. A telemetry antenna 562 is driven by a telemetry transmitter 564 for transmitting a telemetry setup signal 566 to operator console 44 (FIG. 12) and processor 50 therein. These telemetry components and associated signal make up a telemetry link 567. Further components of the mapping tool include a setup dipole antenna 568 which is driven by a setup signal generator 570, a magnetometer 572, a tilt meter 574 and a processing, section 576. Setup dipole 568 is configured along with setup signal generator 570 so as to transmit a fixed, known strength setup signal 580 which is measurable in the same manner as magnetic locating signal 60. Further details of the operation of mapping tool 550 will be provided below in conjunction with a description of its use in setting up and establishing the initial conditions for a drilling array and bore path.

Referring now to FIGS. 12–16, attention is now directed to the way in which the mapping tool illustrated in FIG. 14 functions during drilling array and bore path setup in a setup mode. To this end, reference will simultaneously be made to the flow diagram of FIG. 16. Turning specifically to the flow diagram, it is noted that system operation begins at start step 600. Moving to step 602, drilling array components including drill rig 18, R1 and R2 are positioned as illustrated in FIGS. 12 and 13. As will be seen, exact positioning of these components is not critical within certain overall constraints which will be further described at an appropriate point below. For the present, it is sufficient to say that R1 and R2 must be positioned within receiving range of sonde 510 when the latter is at origin 508 and such that the sonde remains within range of each receiver throughout the entirety of the drill run i.e., all the way to point R. Drill rig 18 should be pointed to begin drilling generally along mapped path 507. Following component placement, initial conditions are established beginning in step 604 in which mapping tool 550 is placed on R1 such that indexing pins 555 on the mapping tool engage an arrangement of recesses 605 on the top of the receiver. It is noted that the cooperating arrangement of pins and recesses is asymmetric to insure proper positioning of the mapping tool on a receiver such that, when so positioned, magnetometer 572 will indicate the orientation of the x axis of the receiver while tilt meter 574 will indicate the orientation of the receiver's z axis with respect to vertical (i.e. the xy plane is level).

At this point during system operation, display panel 556 may present a setup mode screen 606 (FIG. 15) for receiver 1 which includes a magnetic orientation display 608 and a tilt display 610 each of which is shown in graphical and numerical forms. These displays are generated by processing section 576 from the outputs of magnetometer 572 and tilt sensor 574, respectively. Using these displays, the orientation of R1 with respect to north and vertical can be established as initial conditions. This receiver orientation information may be transmitted to processor 50 via telemetry link 529, for example, in response to depressing a first button 559*a* on the mapping tool.

Following step 604, step 612 is performed in which mapping tool 550 is moved to and indexed on R2 (not shown). The $R2_x$ and $R2_z$ axes as related to north and vertical, respectively, can then be determined similarly to the procedure described above for R1 at which time a second button 559*b* may be depressed on the mapping tool. At step 614, upon depressing a third button 559*c*, setup signal 580 is transmitted from setup dipole 568, with the mapping tool still positioned on R2, and is received by R1. R1 detects signal 580 along its receiving axes and transmits this information to processor 50 via telemetry link 529. Using this information, the relationship between R1 and R2 is established by processor 50 based on the known receiver orientations and in accordance with the dipole antenna pattern.

In step 616, mapping tool 550 is moved (not shown) to origin 508 such that setup dipole 568 is oriented master x axis direction. A fourth button 559*d* is thereafter depressed and the mapping tool transmits setup signal 580 which is received by R1 and R2. A telemetry signal 562 also transmits the tilt to processor 50. Each receiver measures signal 580 along its receiving axes and transmits this information to processor 50 via telemetry links 529 and 531. At step 618, processor 50 establishes the coordinates of R1 and R2 within the master coordinate system in relation to origin 508 by using the known initial conditions such as, for example, the orientation of the axes of R1 and R2 along with the known signal strength and orientation of setup dipole 568. At this time, the drilling array is essentially setup such that attention may now be directed to boring tool 26.

In step 620, the signal strength, S, of sonde 510 within the boring tool may be determined, for example, by placing the boring tool at origin 508 such that R1 and/or R2 pick up magnetic locating signal 60 and relay this information to processor 50 via telemetry links 529 and 531, respectively. It should be noted that step 620 may not be required based on the exact configuration of system 500. Specifically, the number of unknown variables which specify the master coordinate location and the orientation of the boring tool (x, y, z, β, ϕ and S) for this system is equal to the number of known variables (six, including: $BR1_x$, $BR1_y$, $BR1_z$, $BR2_y$ and $BR2_z$) such that the system is determinate when S is considered as an unknown variable. In the present configuration of system 500, S will be considered as an unknown variable. Therefore, step 620 is not required. Alternatively, however, S may be set as a constant initially based on the measurement of step 620. In this case the system is over specified, and an LSE approach may be employed, as will be further described at an appropriate point below. It should also be understood that, if S is specified as a constant, any one magnetic component measurement may be eliminated such that a total number of five magnetic measurements are taken since only five unknowns (x, y, z, β and ϕ) remain in this determinate solution. Still another magnetic component measurement may be eliminated if a pitch sensor is relied on to provide physically measured pitch values. Additionally, magnetic component readings may be taken from more than two receivers. In fact, six receivers could be located at different positions and may be configured with one antenna apiece to achieve six measurements. However, it should be appreciated that considerable computational power would have to be brought to bear in order to perform the required positional computations using such a number of different receivers.

Figure 16:
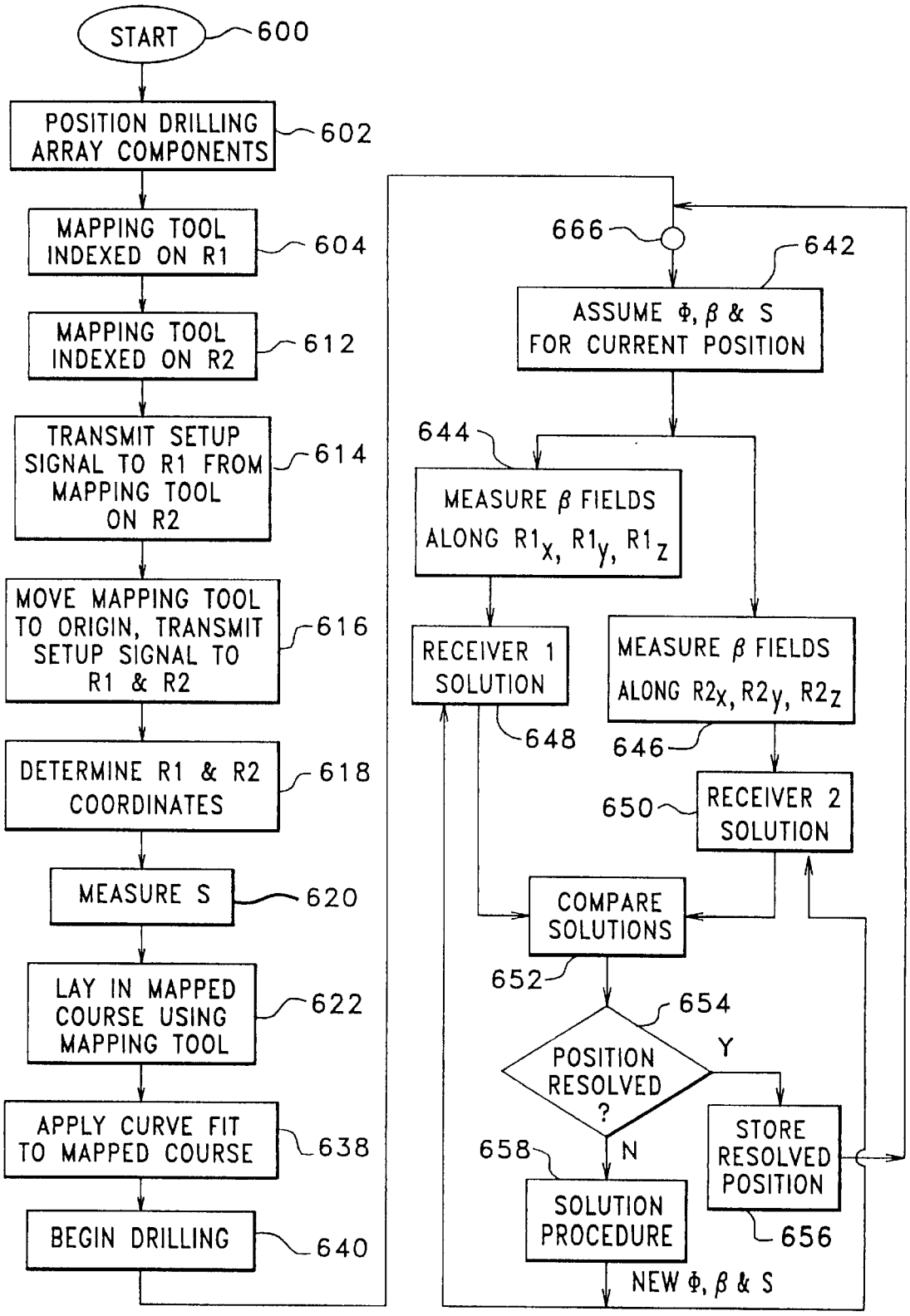
FIG. 16 is a flow diagram illustrating a procedure which considers locating the boring tool of FIGS. 12 and 13 in three dimensions while performing the horizontal boring operation by using three measured components of the magnetic locating signal emanated from the boring tool.
Figure 17:
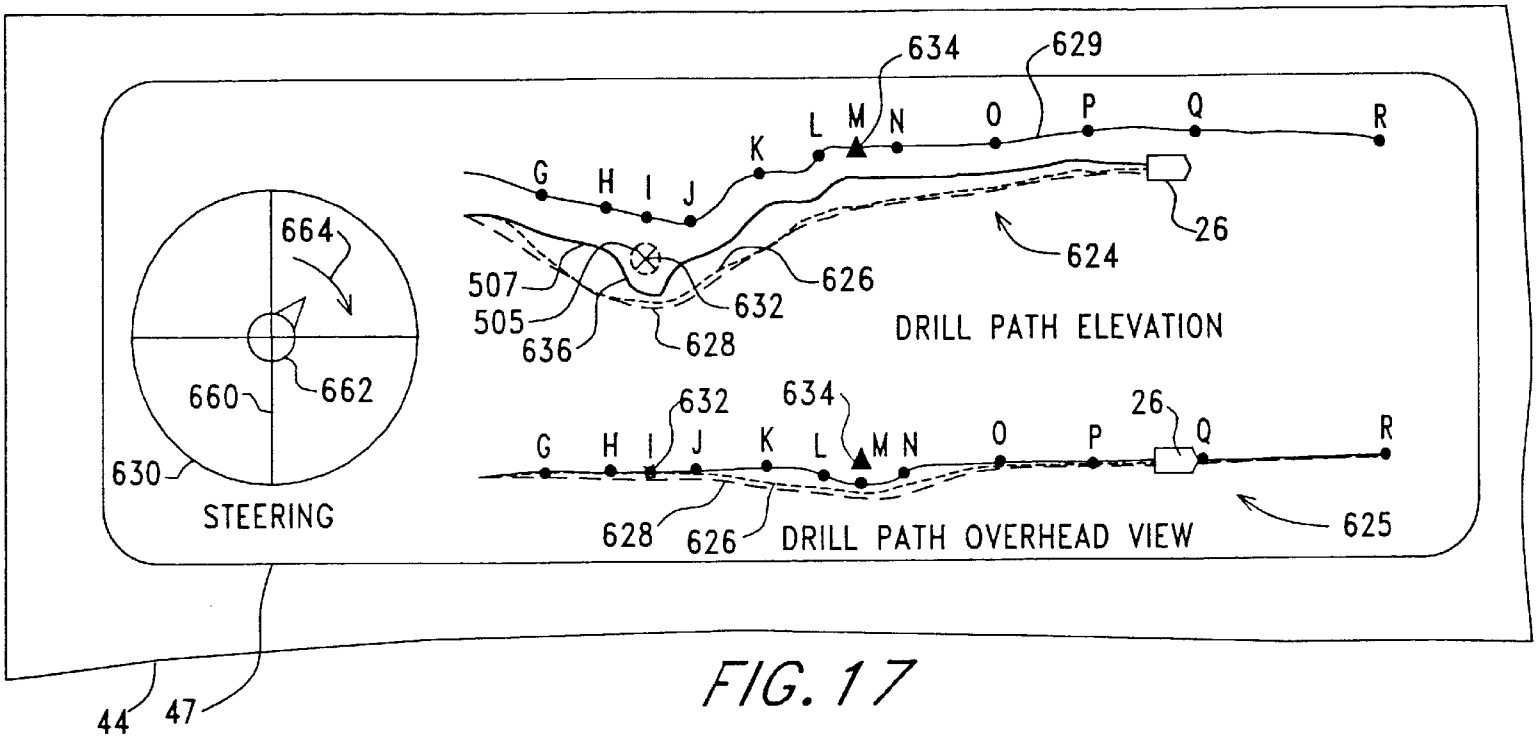
FIG. 17 illustrates the appearance of a display screen on an operator console including plots representing the exemplary drilling run depicted in FIGS. 12 and 13 along with a steering coordinator display which is useful in guiding the boring tool relative to the illustrated plots.

Referring now to FIG. 17 in conjunction with FIGS. 12–16, mapping tool 550 is used in step 622 to lay out or plot mapped course 507 in a course mapping mode. The mapped course is ultimately displayed on display 47 at operator console 44 in a drill path elevation display 624 and a drill path overhead view display 625, during the drilling operation. A target path 626 and the actual drilling path 628 taken by the boring tool are also shown. A surface plot of the ground is indicated by reference number 629. A steering coordinator display 630 is also provided on display panel 47. Target path 626 and steering coordinator display 630 will each be described at appropriate points below. The course mapping mode may be entered, for example, through a menu selection (not shown) on display 556 or by pressing a button 559e on the mapping tool. Once in the course mapping mode, an overall desired depth below the mapped surface 629 of the ground may be entered/specified for the entirety or a specific point of the drilling run on the mapping tool or, alternatively, at operator console 44.

Beginning with exemplary point G, the mapping tool (shown in phantom in FIGS. 12 and 13) may be placed on the ground or, in some embodiments, may be held directly above the desired point by the operator wherein the distance to the surface of the ground may be detected, for example, by an ultrasonic sensor in a walkover locator (see previously referenced U.S. Pat. No. 5,337,002). A button 559*f* is then depressed whereby to cause transmission of setup signal 580 from dipole 568 within the mapping tool. R1 and R2 pick up the setup signal and transmit magnetic information corresponding with point G back to operator station 44 via telemetry links 529 and 531, respectively. Processor 50 then calculates the position of point G and offsets this position downward to the desired depth as a point along the mapped course. Point G is then added to surface plot 629 and mapped course 507 is correspondingly extended at the specified offset therebelow. It should be mentioned that FIG. 17 illustrates display 47 during the actual drilling operation (i.e., the mapping mode has been completed). For purposes of brevity, the actual updating of display 47 during the mapping mode is not illustrated since the reader is familiar with such a process. However, it should be appreciated that the mapped course may be progressively updated with the addition of each new point entered by the mapping tool or re-plotted following additional processing steps which will be described below. Of course, during the mapping mode, surface plot 629 and mapped course 507 may extend, at most, only to the furthest mapped point from drill rig 18.

As step 622 continues, subsequent points along the desired drilling path are entered in the manner of point G. Once point I has been reached, however, special provisions may be made. As previously noted, conduit 505 passes through the desired path of the boring tool at point I and at a depth which corresponds to the set drilling depth for the present drilling run. Under the assumption that the location and depth of conduit 505 are known to the system operator, the location and depth of the conduit may be entered for point I as a drilling obstacle which can be symbolically represented on display 47. In the present example, the conduit is denoted by an "X" 632 as representing an obstacle which the boring tool must pass either above or below. Additionally, the set drilling depth may be overridden for point I and set, for example, to a deeper depth such that the boring tool passes below conduit 505. In this manner, mapped course 507 may advantageously be tailored to clear obstacles at known depths. In many cases, the location of such obstacles is generally known. Since damaging an underground line as a result of contact with the boring tool can be quite costly, such lines are typically partially uncovered prior to drilling so that their location and depth is, in fact, precisely known. Within this context, the use of mapping tool 550, as described, is highly advantageous.

Still considering step 622, another type of drilling obstacle is encountered in the mapping process upon reaching point M, i.e., boulder 504 (FIGS. 12 and 13). Of course, mapped points L, M and N define the desired lateral path around the boulder. As with X "632", denoting conduit 505, the location of boulder 504 may be entered for point M as a drilling obstacle which can be symbolically represented on display 47. In the present example, the boulder is indicated by a solid triangle 634 which denotes that the obstacle must be steered around laterally. It is to be understood that obstacles of different types may be denoted using an unlimited number of different conventions which imply different connotations in accordance with the present invention. Symbolic identification of obstacles is particularly useful in that a system operator is reminded by such symbols that apparent anomalies in the mapped drilling path are caused by actual obstacles which must be avoided by steering. Step 622 and the mapping mode concludes upon reaching point R.

It is to be understood mapping tool 550 may be configured in an unlimited number of different ways in accordance with the teachings herein. Data entry and selection may be performed in any manner either presently known or to be developed. For example, its display 556 may be menu driven and/or touch sensitive. One of skill in the art will recognize that the advantages provided by the mapping tool in establishing the path which is ultimately followed by the boring tool have not been seen heretofore and are not shared by typical prior art systems such as, for example, a walkover system. In that light, the mapping tool could contain additional circuitry so that it could also perform as a walkover locator.

At this juncture, it is to be understood that information from which mapped course 507 is plotted may be entered manually, as opposed to using mapping tool 550. Points along mapped course 507 may be identified, for example, using surveying techniques. As these points are entered, the system may automatically use the desired drilling depth or, as described above, an override depth may be entered. Entry of obstacles essentially remains unchanged. With regard to system 10, in all of its various configurations, the mapped course points obstacles and any override depths are manually entered at operator console 44. Once this information is available to processor 50, the data may be ordered (for out of sequence entries) and the curve fitting process, which leads to the generation of target path 626 may be carried forth, as described above. In fact, system 10 is considered to be indistinguishable from system 500 from the viewpoint of an operator of the system during actual drilling. Therefore, discussions appearing below with regard to steering and guiding the boring tool along target path 628, based on information presented on display 47, are equally applicable to system 10.

Referring to FIG. 17, it should be noted that drilling, strictly as defined by mapped course 507, may not be practical or desired in certain circumstances. Point I provides an example of one such circumstance. Specifically, point I in mapped course 507, is set to a considerably deeper depth than immediately adjacent points H and J so as to avoid conduit 505. This results in a pronounced dip 636 in the mapped course. In most cases, a drill string will have a minimum bend radius. The latter may be violated by the sharp curvatures of dip 636. In fact, attempting to drill along these curvatures could result in costly damage to or breakage of the drill string, along with significant project delays. Therefore, in step 638, processor 50 advantageously applies a curve fitting algorithm to mapped course 507 which considers important factors such as, for example, the minimum bend radius of the drill string, the overall contour of the mapped course, obstacles entered by the operator and the depths of points along the mapped path. Based on all of these factors, the curve fitting process generates target path 625.

In comparison with the mapped path, over points G–N, it can be seen that the target path deviates significantly from mapped path 507. In part, this deviation is due to the required depth at point 1 in view of the minimum bend radius of the drill string. Additionally, the contour of the ground over points K–N is somewhat rough, as is reflected in the corresponding portion of the mapped course, plus boulder 504 is encountered (at triangle 634). Thus, deviation from the target path over points K–N can also be attributed to the curve fitting process which is configured for smoothing mapped course 507 so as to provide for a generally straighter drilling course rather than needlessly rough surface oscillations. At the same time, however, it should be noted that the operator may optionally override step 638, using the mapped course exclusively, or enter a target course of his/her own. It is noted that display of all of the information shown in FIG. 17 may not be required. In particular, target path 625 may be displayed in lieu of mapped course 507, since the system operator may have little use for the plot of the mapped course, particularly in the case of a relatively inexperienced operator. Moreover, elimination of some information may serve to avoid unnecessary confusion on the part of the system operator. Additionally, mapped points (G–R) along the mapped course may be shown or not shown at the option of the operator. Other data may also be displayed such as, for example, the distance from the drill rig to the boring tool.

It is noted that the present invention contemplates mapping points G–R out of sequence. In this way, a point may be added, modified or deleted in the mapped course even after the end point (R, in this example) has been entered. As an example with reference to point 1, its set drilling depth may be increased such that the mapped course passes still deeper below (not shown) conduit 505. When a collection of points has been entered out of sequence, system 500 may defer plotting the mapped course until such time that the operator indicates that all of the points for the plot have been entered. Thereafter, the points may be ordered for plotting purposes prior to applying curve fitting in step 638.

Referring to FIGS. 16 and 17, once target path 626 has been established, drilling may begin. In step 642, for any particular position of the boring tool, an initial orientation ($\phi$ and $\beta$) is assumed of sonde 510 along with its signal strength, S. At origin 508, typical initial values may be assigned such as, for example, $\phi_o$=30°, $\beta_0$=0° and a typical value for S. For subsequent positions, the last known, $\phi$, $\beta$ and S may be used. For example, if boring tool 26 has just arrived at point H (not shown) enroute from point G, step 642 may initially assume the values $\phi_G$, $\beta_G$ and $S_G$. As will be seen, these assumed values are not particularly critical in that the system automatically computes correct values which replace the initially assumed values. Moreover, processor 50 may modify $\phi_G$, βG and $S_G$ for the assumed values based, for example, on any steering actions taken by the operator since point G.

In step 644 and during drilling, components $BR1_x$, $BR1_y$, $BR1_z$ of magnetic locating signal 60 are measured along R1's receiving axes while in step 646 components $BR2_x$, $BR2_y$ and $BR2_z$ of magnetic locating signal 60 are measured along R2's receiving axes. As described above, it should be appreciated that, once values for ϕ, β and S are assumed, only one position within the master coordinate system will satisfy the resulting dipole relationship for this determinate system. Following step 644, R1 antenna solution step 648 is performed wherein the assumed values for ϕ. β and S are used in conjunction with $BR1_x$, $BR1_y$ and $BR1_z$ to compute an $(x,y,z)_{R1}$ position. This computation is preferably performed using the triple transform technique which was described above with reference to FIGS. 5 and 6*a–c*. Concurrently, R2 antenna solution step 650 is performed in a similar manner using $BR2_x$, $BR2_y$ and $BR2_z$ along with ϕ, β and S to compute an $(x,y,z)_{R2}$ position. $(x,y,z)_{R1}$ and $(x,y,z)_{R2}$ are provided to step 652 and a solution difference value is determined.

In step 654, the solution difference value is tested so as to determine if the solutions agree. If the test is satisfied, step 656 is performed in which the resolved position, satisfying step 654, is stored. Thereafter, a predetermined period of time may be permitted to elapse prior to returning to magnetic field measuring steps 644 and 646 so as to allow for sufficient movement of the boring tool. If the test is not satisfied, a solution procedure 658 is entered in which new values for ϕ, β and S are assumed. Solution procedure step 658 is configured for converging the $(x,y,z)_{R1}$ and $(x,y,z)_{R2}$ positions by calculating new values for S, β and ϕ, much like previously described solution procedure step 140 of FIG. 4, by using a known convergence algorithm such as, for example, simplex or steepest descent.

The new values of S, β and ϕ are then assumed by the system and used in steps 648 and 650 to compute new $(x,y,z)_{R1}$ and $(x,y,z)_{R2}$ positions, respectively. This iterative process is repeated until such time that position resolved step 654 is satisfied. As the boring tool progresses along its actual drilling path 628, its position may be calculated for a multitude of points therealong. Using the triple transform technique, it has been found that a position may be calculated approximately every 0.01 seconds using a Pentium processor with the physical separation of the positions, of course, being dependent upon the speed of the boring tool. It should be appreciated that each position determination performed in accordance with the process described by FIG. 16 is essentially independent of previous position determinations.

The above described procedure can also be used to determine the locations of R1 and R2 if the boring tool's position and orientation are known, since the procedure calculates the position of the boring tool relative to R1 and R2. For this implementation, the angular orientation of R1 and R2 must be known. This can be accomplished by leveling and aligning one axis on each cluster in a known direction. For example, the direction could be relative to north or some optical reference such as, for example, another cluster or some object visible (i.e. line of sight) to both R1 and R2.

Referring to FIGS. 12 and 17, drill path elevation display 624 and drill path overhead view display 625 are actively updated by processor 50 in accordance with the underground progression of boring tool 26 along actual drilling path 628 whereby to aid an operator of system 500 in guiding the boring tool. Previously mentioned steering coordinator display 630 provides additional assistance by graphically showing the operator an appropriate steering direction which will either keep the boring tool on target path 626, if it is on course, or return the tool to the target path, if it is off course. Steering coordinator display 630 includes cross hairs 660 and a steering indicator 662. The specific behavior and position of the steering indicator is dependent upon the particular steering action which should be undertaken by an operator using controls 52 at operator console 44. Normally, the drill string and boring tool rotate during straight boring. When it is desired to steer the boring tool, its rotation is stopped and asymmetric face 27 of the tool is oriented so as to deflect the tool in the desired direction. In FIG. 17, steering indicator 662 is centered on cross hairs 660 and rotating in the direction indicated by an arrow 664. This behavior simulates the action of the boring tool for straight ahead boring and, thereby, indicates that boring should proceed straight ahead in order to remain on course. The steering coordinator display of FIG. 17 is appropriate for positions along target path 626 corresponding to points H and K since the boring tool was on course as it passed these points, in view of the completed portion of actual drilling path 628. In other words, the steering coordinator display of FIG. 17 would not have been correct for points H and K if, in fact, the tool had been off course.

Figure 18:
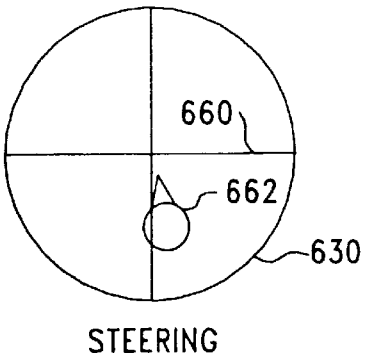
FIG. 18 illustrates the appearance of the steering coordinator of FIG. 17 for one particular point along the exemplary drilling run.

Turning to FIGS. 17 and 18, steering coordinator display 630 is illustrated for the position along target path 626 corresponding with point I. In this example, steering indicator 662 does not rotate but, rather, points at the center of cross hairs 660 from below and slightly to the right. Comparison of FIG. 18 with FIG. 17 reveals that, at point I, mapped course 626 is proceeding upward after having passed under conduit 505, in drill path elevation view 624, and that actual drilling path 628 (denoting the actual position of boring tool 26 at the time that it passed by point I), in drill path overhead view 625, is slightly to the right of target path 626. Therefore, the operator, in order to return to the target path, should steer upward and slightly to the left, as indicated by the pointer of steering indicator 662.

Figure 19:
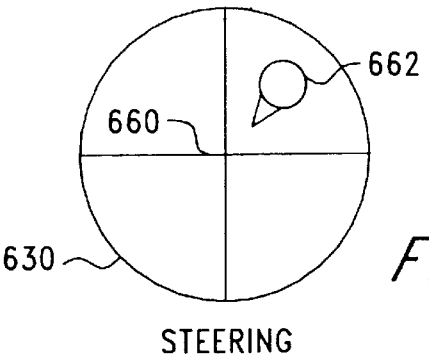
FIG. 19 illustrates the appearance of the steering coordinator for another point along the exemplary drilling run.

FIG. 19 in conjunction with FIG. 17 illustrates still another steering situation corresponding with point M. Comparison of FIG. 19 with FIG. 17 shows that, at point M, mapped course 626 is curving downward, in drill path elevation view 624, and curving to the left in drill path overhead view 625. Furthermore, actual drilling path 628 is slightly to the right of target path 626. Therefore, steering indicator 662 points at the center of cross hairs 660 from above and to the right. In response, the operator should steer downward and to the left, as indicated by the pointer of steering indicator 662, in order to return to the target path.

It is mentioned that the exact algorithm used to drive the steering display can include consideration of the minimum bend radius of the drill pipe. Such consideration would permit the shortest distance to return the boring tool to the desired path without over stressing the drill pipe. Other algorithms could also be employed which reflect specific drill rig or operation restrictions.

Referring to FIGS. 1 and 12, it should also be mentioned, with further regard to the subject of steering the boring tool, that the present invention contemplates implementation of a fully automatic steering arrangement. For example, an automatic steering module 665 may be added to operator console 44 as shown for systems 10 and 500. One of skill in the art will appreciate that all information required for such an implementation is essentially already available based on the display of FIG. 17. Therefore, automatic steering module 665 may interface processor 50 (or may incorporate another processor which is not shown) with the controls 52 using suitable actuators (not shown). It is considered that the development of appropriate automatic steering software is considered to be within the capability of one skilled in the art. In an automatic steering implementation, the role of the system operator may primarily comprise setting up the drilling array and, thereafter, monitoring the progress of the boring tool. As another feature, even in the non-automatic implementations described above, an audio and/or visual warning may be provided if the position of the boring tool deviates from the target path by more than a predetermined distance, thereby allowing for inattentiveness on the part of the operator.

Having described one configuration of system 500 in which the signal strength, S, of sonde 510 and pitch, $\phi$, of boring tool 26 are both considered as unknown variables, a discussion will now be provided for alternative configurations of system 500 in which S and/or $\phi$ are considered as known or measured variables. Since the impacts of such changes on the flow diagram of FIG. 16 are minimal, reference will be made thereto for purposes of the present discussion with additional descriptions being provided only for modified steps or for added steps. In accordance with a first alternative configuration, S is measured in step 620 and, thereafter, set as a constant, $S_c$, for the entirety of the drilling run. Receiver 1 and Receiver 2 antenna solution steps 648 and 650 then utilize $S_c$ in determining $(x,y,z)_{R1}$ and $(x,y,z)_{R2}$, respectively. Since system 500 is over specified with S to $S_c$, solution comparison step 652 may utilize an LSE approach in a manner which is consistent with the LSE approaches described previously with regard to system 10. Specifically, step 652 may compute the square error, SE, based on positions $(xyz)_{R1}$ and $(xyz)_{R2}$ wherein:

$$SE=W_x(x^2_{R1}-x^2_{R2})+W=(y^2_{R1}-y^2_{R2})+W=(z^2_{R1}-z^2_{R2}) \quad (19)$$

Where $W_x$, $W_z$ and $W_y$ are optional weighting functions used to improve accuracy, as described with regard to system 10.

System 652 can compare the two solutions using the square error in position, as previously described, or can compare the two solutions based on calculated flux at the two antenna receiver clusters. For this latter approach, the position calculated based on the flux measured at receiver 1 is used to calculate the flux at receiver 2 and vice versa. The square differences can then be summed to form an error function which can be minimized by solution procedure 658. Weighting functions can be incorporated into the process to address such practical problems such as measurement accuracy and background noise. One such weighting function is the signal (flux) to noise ratio (S/N). The accuracy of a measurement diminishes as the signal level approaches the noise level. Therefore, if the square flux error, that is, the square of the difference between the measured and calculated flux is multiplied by the S/N ratio, then more emphasis would be applied to the larger signals which would be more accurate. Limits could be applied to the weighting factors, for example, they would be limited to values less than ten. Any S/N above the value of ten would be set to ten. This would eliminate undue dominance of the solution on any one or a few variables, yet reduce the influence of the solution on signals near the noise level.

It should be mentioned here that the error function just described could also be applied to the dead reckoning system. For that system, the position determined by the integration path would be used to calculate the flux at the antenna. The calculated flux component or components would be differenced from the measured flux component or components and squared to form the square error function. Weighting functions could also be applied for the previously described purposes.

Position resolved step 654 may then determine if SE is at a minimum value i.e., the LSE. If so, step 656 is performed. On the other hand, if SE is not at a minimum, solution procedure step 658 is performed which is configured for converging the two positions based on the square error by calculating new values for $\beta$ and $\phi$, much like previously described solution procedure step 218 of FIG. 7, by using a known convergence procedure such as, for example, Simplex or steepest descent. The new values of $\beta$ and $\phi$ are returned to steps 648 and 650, beginning the iterative process described above until such time that SE reaches its minimum value in step 654.

In a second alternative configuration of system 500 and referring initially to FIGS. 12 and 16, previously described pitch sensor 174, positioned in boring tool 26, may be used to measure, $\phi$, such that $\phi$ is no longer an unknown variable. It is noted that, for the present examples S will be considered as an unknown. The FIG. 16 flow diagram is changed in one respect, as a result of this configuration, in that an additional step (not shown) is inserted at a node 666 immediately prior to steps 648 and 650 in which the pitch measurement is taken for the current position of the boring tool. Steps 648 and 650 then compute $(x,y,z)_{R1}$ and $(x,y,z)_{R2}$ based upon their respective measured magnetic components along with the measured $\phi$. As in the first alternative configuration, the present configuration is over specified by one variable and, therefore, step 652 computes SE while step 654 checks for the LSE. In step 658, the solution procedure provides new values for $\beta$ and S which are returned to steps 648 and 650. The remainder of the procedure is performed as described above with regard to the first alternative configuration.

A third alternative configuration (not shown) may be implemented in which S is considered as a constant and $\phi$ is measured. This configuration is over specified by two variables. A detailed discussion will not be provided herein for this alternative in that it is considered that one of skill in the art will readily be capable of constructing and using such an implementation in view of the preceding discussions. It should also be mentioned that hybrid configurations may be developed which combine selected features of system 10 and system 500. In fact, the use of pitch sensor 174 in the second and third alternative configurations, immediately above, may be viewed as such a hybrid. Also, during a particular boring run certain parameters may be determined in different ways. For example, it has already been discussed with regard to system 10 that pitch may be determined by a pitch sensor while stationary and may be calculated while drilling.

Figure 20:
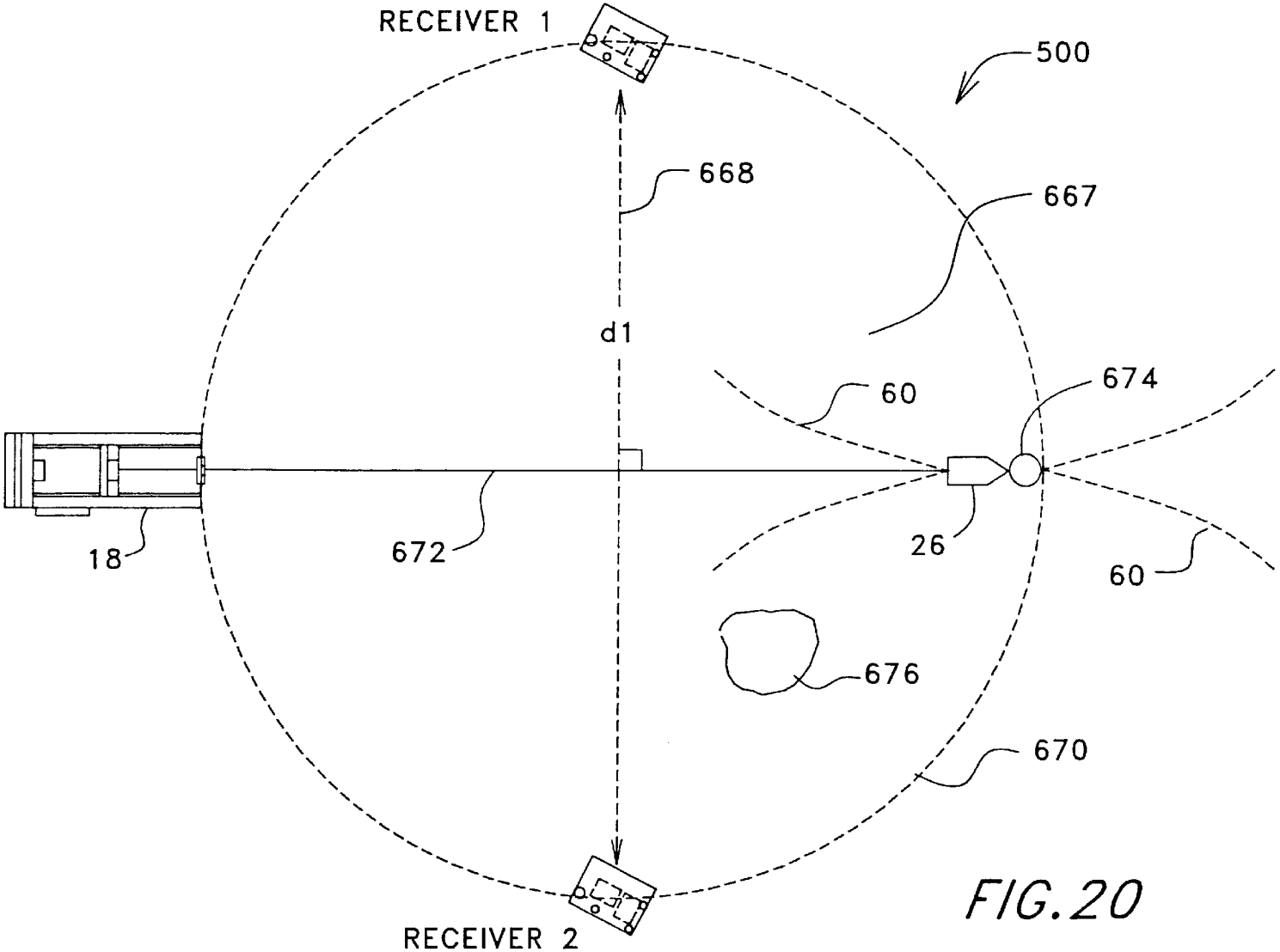
FIG. 20 is a diagrammatic plan view illustrating a drilling array layout defining a circular drilling area in association with the horizontal boring system initially shown in FIGS. 12 and 13.

Turning now to FIG. 20, in which an optimal drilling array layout 667 for system 500 is diagrammatically illustrated, R1 and R2 are shown separated by distance d1 along a path 668. Distance d1 forms the diameter of a circular drilling area 670. Drill rig 18 is arranged along the perimeter of drilling area 670 such that an intended drilling path 672 extends to a drilling target 674. Intended drilling path 672 is substantially perpendicular to and bisects d1. Additionally, the intended drilling path is entirely within drilling area 670. It should be appreciated that errors in position determination based on magnetic locating signal 60 may be encountered in certain circumstances. For example, a mass of ferrous metal 676 may distort the magnetic locating signal. In accordance with the present invention, it has been discovered that the drilling array layout of FIG. 20 is highly advantageous for a particular reason. Specifically, when an error in position determination is encountered due to such distortion within drilling area 670, system 500 exhibits a remarkable ability to recover from such errors, resulting in the ultimate arrival of boring tool 26 at target 674. Other studies by Applicants have shown that as long as boring tool 26 is within circle 670, regardless of tool orientation, the calculated position is less sensitive to errors. While intended drilling path 672 is illustrated as being straight and perpendicular to dl, this is not a requirement so long as boring tool 26 is constrained to drilling area 670, and the receivers are constrained to opposing positions on any diameter of area 670, system 500 continues to exhibit a substantial ability to recover from positional errors. Outside the circle, the system will still function effectively, but can be more sensitive to error.

Figure 21:
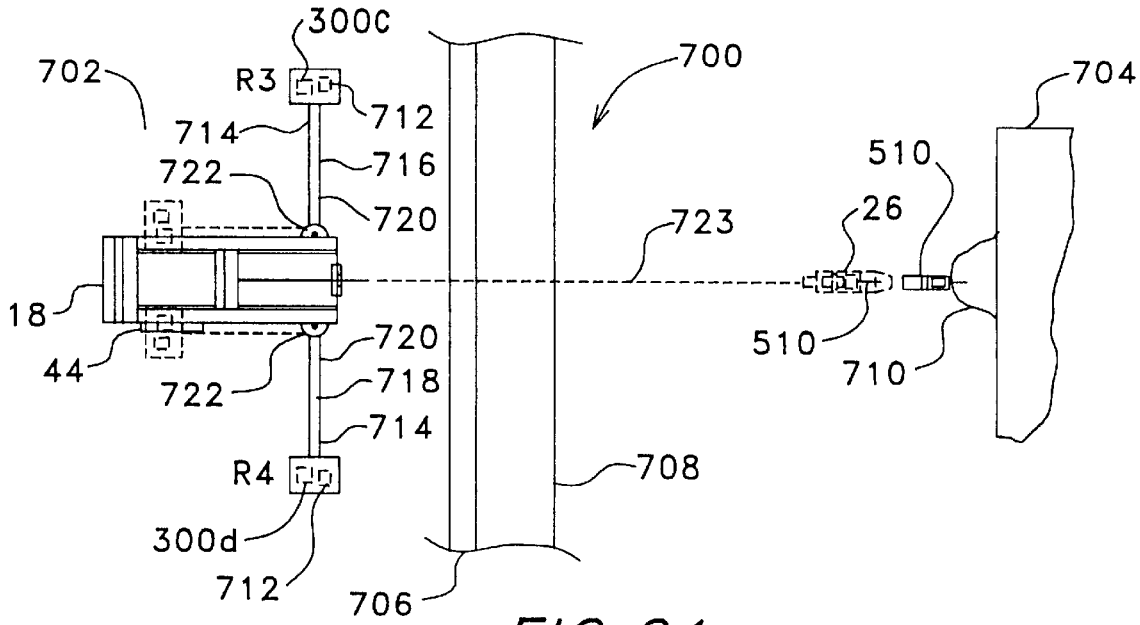
FIG. 21 is a diagrammatic plan view illustrating one modified version of the horizontal boring system, which was originally shown in FIGS. 12 and 13, that is configured for service line installation.

Turning now to FIG. 21, a specially modified service line installation version of system 500 is illustrated and will be referred to hereinafter as system 700. In that system 700 includes certain components which are identical with components used in previously described systems 10 and 500, like reference numbers will be applied whenever possible and the reader is referred to previous descriptions of these components. System 700 is positioned in a street 702 opposing a home 704 with a curb 706 and sidewalk 708 therebetween. A pit 710 has been excavated adjacent home 704. The configuration of system 700 is tailored for use in the drilling configuration of FIG. 21 wherein it is desired to install a service line such as, for example, a fiber optic line (not shown) from the street to home 704. Specific advantages of system 700 in this drilling application will be described in detail at appropriate points below.

Still referring to FIG. 21, system 700 includes drill rig 18 along with a pair of receivers R3 and R4. It sho be mentioned that drill rig 18 is normally mounted on a truck or other vehicle in order to facilitate movement of the rig, however, this is not shown for purposes of simplicity. R3 and R4 include cubic antennas 300*c* and 300*d*, respectively. An electronics package 712 is, associated with each cubic antenna. Electrical cables, which are not shown for purposes of simplicity, connect electronics packages 712 with operator console 44. R3 and R4, unlike previously described receivers R1 and R2, do not require telemetry components. Similarly, operator console 44 does not require telemetry components for the present configuration. Thus, the attendant costs of telemetry links are advantageously eliminated.

In accordance with the present invention, R3 and R4 are mounted on outward ends 714 of a pair of receiver arms 716 and 718. Inner ends 720 of the receiver arms are pivotally received in locking hinge arrangements 722 which are fixedly attached to the sides of the drill rig. The receiver arms are moveable between a transport position (shown in phantom) against the sides of the drill rig and a locked drilling position extending outwardly from the drill rig, as depicted. It should be appreciated that, when the receiver arms are in their locked drilling positions, R3 and R4 are in known positions and orientations which may be precisely measured, for example, as a manufacturing step and preprogrammed into the system. For this reason, very little setup is required once the system is located at a drilling site beyond simply swinging out the arms and mapping points, as needed, along a desired drilling path 723. Mapping may be performed using previously described mapping tool 550, keeping in mind that the associated telemetry components at operator console 44 should be installed, if all of the advantages of the mapping tool are to be realized. If it is desired to hold the cost of system 700 to the lowest possible level, one highly advantageous technique may be employed which avoids the need for the mapping tool, as will be described immediately hereinafter.

Continuing to refer to FIG. 21, sonde 510 is typically configured for removal from boring tool 26 such that its batteries may be replaced or a different sonde may be installed. In this removed state, sonde 510 may be used as an elementary mapping tool. For example, the sonde (shown in phantom) at the location of pit 710 may be positioned on the ground, while transmitting. At operator console 44, the operator may indicate to the system that the present location of the sonde is the end point of the drill run including a specific downward offset. The system then may locate the sonde at the pit and, with this straightforward process, a linear drilling run has been mapped. Of course, intermediate points on the drilling run whereby, for example, to avoid obstacles or for uneven terrain may be entered in a similar manner by appropriate positioning of the sonde and entry of such points into the system.

Having described the features of system 700, one of skill in the art will appreciate its usefulness and cost effectiveness in the installation of utility service lines, for example, to homes. With regard to cost effectiveness, one important consideration resides in the fact that system 700 may readily be operated by a single person. In the case where a utility company is installing lines, such as fiber optic cables, to essentially every home within an entire city, any time saved in setup during the use of an underground boring system for a single installation will be multiplied many times over. System 700 provides the capability to install such lines with an ease and at a rate which has not been seen heretofore. However, it is to be understood that its use is not considered as being limited to service line installation, but effectively extends to other drilling applications, as will be mentioned hereinafter.

Figure 22:
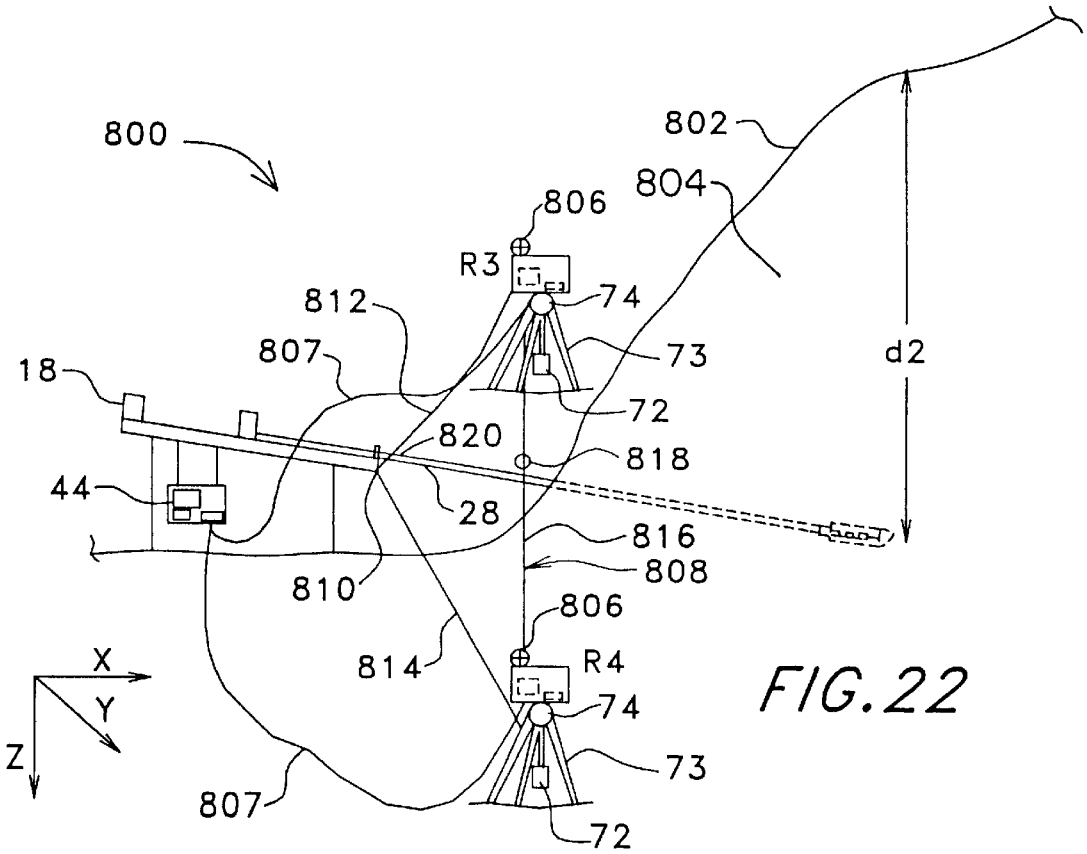
FIG. 22 is a diagrammatic elevational view illustrating another modified version of the horizontal boring system, which was originally shown in FIGS. 12 and 13, that is configured for drilling into a hill or mountain.

Reference is now taken to FIG. 22 which illustrates still another version of system 500 that is generally indicated by the reference number 800 and referred to hereinafter as system 800. System 800 is configured for drilling into the side 802 of a hill 804 and includes certain components which are identical with components used in aforedescribed systems 10, 500 and 600. Therefore, like reference numbers will be applied whenever possible and the reader is referred to previous descriptions of these components. As with all previously described systems, system 800 may also be truck or other vehicle mounted (not shown). Drilling into a slope, hill or mountain may be performed, for example, in cases where hill 804 is comprised of unstable soils and/or formations. In order to stabilize the soils or formations, steel rods (not shown) may be inserted into bores made by system 800. In the prior art, the task of guided drilling into a hillside has been somewhat daunting. Prior art walkover systems are not particularly suited to this application since a walkover locator must be placed directly above the boring tool in order to ascertain its position. This may not be practical for two primary reasons: (1) hillside 802 may be so steep that a person is not able to walk thereupon and (2) soil depth d2, directly above the boring tool, may rapidly increase in depth to such an extent that the "through-ground" transmission range from the boring tool to the walkover locator is quickly exceeded. Prior art homing type systems (not shown) also exhibit impracticality in this application. In these systems, the boring tool homes in on a receiving antenna system which must be positioned at or near the ultimate destination of the boring tool. Obviously, this is not a practical approach to the problem of guided drilling into a hillside since there is no way to initially position the antenna system near the end-point of the bore. In contrast, system 800, provides a practical and highly advantageous approach to this problem, as will be seen immediately hereinafter.

Continuing to refer to FIG. 22, system 800 further includes receivers R3 and R4 supported by gimbals 74 which are, in turn, received by tripods 73. The receivers are maintained in a level orientation using counterweights 72 or leveled in some other way. Each receiver may also include a sight glass 806 which is aligned along a particular receiving axis such as, for example, the x axis (not shown) of the cubic antenna within each receiver. The sizes of sight glasses 806 have been exaggerated for illustrative purposes. R3 and R4 can be connected in lieu of telemetry with operator console 44 using a pair of cables 807 in a manner which is similar to that described with regard to system 700, above. As is the case with all systems disclosed herein, the initial orientation of receivers R3 and R4 must be established prior to beginning the drilling operation. To that end, the use of a mapping tool has been avoided, once again, as a cost saving measure. Positioning of R3 and R4 is accomplished in the present example in an effective, but low cost manner. Specifically, system 800 uses a rope arrangement 808 which is attached between tripods 73 supporting the receivers and a point 810 on the drill rig. Rope arrangement 808 includes a first rope length 812 which extends from the drill rig to R3's tripod and a second rope length 814 which extends from the drill rig to R4's tripod. A third rope length 816 extends between the R3 and R4 tripods. This latter length includes a center marker 818 which is positioned midway between the receivers. It is noted that the ropes are attached to the tripods such that the leveling action of the gimbals and counterweights, if used, is not affected. When setting up the drilling array, rope arrangement 808 is simply extended, as shown, such that center marker 818 is positioned dead ahead of drill rig 18 along a straight drilling path therefrom. Orientation of the receivers may then be set using sight glasses 806 to aim the x axis of each receiver along rope 816.

At this point, the x and y positions of the receivers have been established relative to the drill rig along with the orientations of the receivers. The vertical or z axis positions of the receivers are now established by first transmitting from sonde 510 at a known position and orientation, such as the origin, which may, for example, be at a position 820 just beyond the end of the drill rig frame prior to extending drill string 28. Thereafter, using the magnetic data measured by each receiver, their z axis positions may be determined relative to position 820. Drilling may then proceed. Alternatively, of course, mapping tool 550 may be used in establishing the illustrated drilling array layout of system 800. Many other methods for establishing the drilling array layout may also be devised within the scope of the present invention. It is to be understood that systems 500 and 700, may readily be employed in the application of drilling into a hillside. Irrespective of which system is used, the problem of drilling into a hillside is essentially resolved by the present invention. In fact, these systems are adaptable to any drilling situation disclosed herein and, further, may be effectively adapted to virtually any guided boring application.

Figure 23:
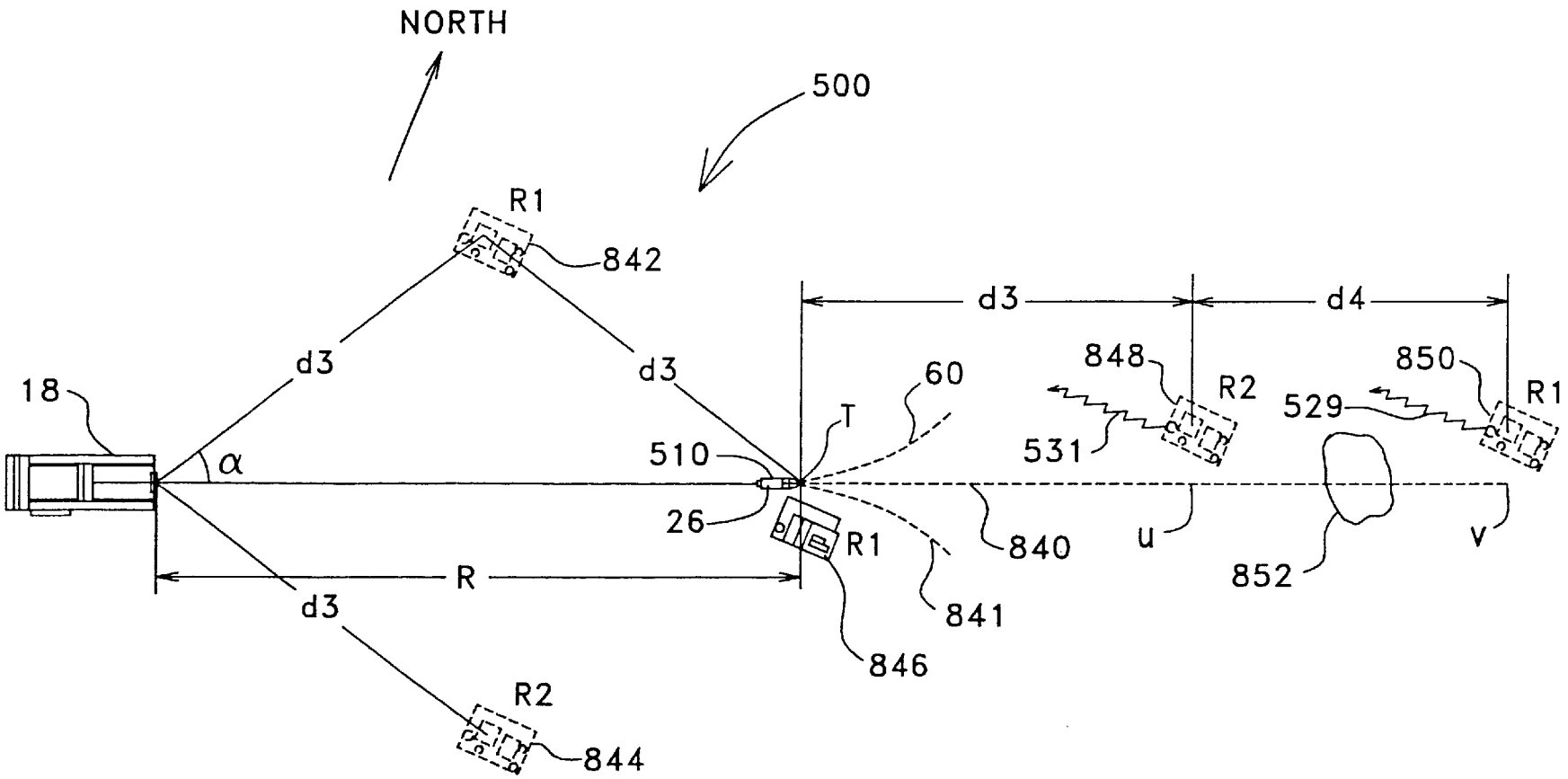
FIG. 23 is a diagrammatic plan view showing the horizontal boring system which was originally shown in FIGS. 12 and 13, shown here to illustrate a technique for performing long drilling runs.

Referring now to FIG. 23, system 500 is illustrated in a configuration which is specifically adapted for long drilling runs. Drill rig 18 is illustrated, along with R1 and R2, setup and performing such a long drilling run along a drilling path 840 in an area 841 wherein boring tool 26 has reached a point T. R1 and R2 (shown in phantom) are initially located at positions 842 and 844, respectively. As will be appreciated, a maximum through-ground transmission range exists between sonde 510 and receivers R1/R2 which is indicated as a distance d3. For this initial positioning of R1 and R2, any point along drilling path 840 up to point T is, therefore, within range of both receivers, as is required for determining the position of boring tool 26. Furthermore, an angle $\alpha$ is formed between d3 and drilling path 840 such that the maximum range, R, of boring tool 26 from drill rig 18 is determined by the equation:

$$R=2\cdot d3\cos\alpha \tag{20}$$

At point T, the position and orientation of the boring tool are known based upon magnetic information gathered by R1 and R2 at positions 842 and 844. In order to continue drilling, R1 is moved to a position 846 which is generally adjacent to point T while R2 is moved to a position 848 which is generally adjacent to a point U, along drilling path 840. Points T and U are separated by a distance of approximately d3.

Continuing to refer to FIG. 23 and after the receivers have been moved to positions 846 and 848, received magnetic components along each receiving axis of the respective receivers may be used to determine the locations of positions 846 and 848 and the orientations of R1 and R2 by transmitting magnetic locating signal 60 from the known location and orientation of boring tool 26. These determinations are possible, based on dipole relations, since the only unknowns are the x, y and z coordinates for each receiver. Having established the coordinates for positions 846 and 848, boring may proceed until such time that the boring tool reaches point U. At point U, the boring tool is separated from R1 at position 846 by approximately d3 such that any further separation between the boring tool and R1 is likely to result in loss of locating signal 60 by R1. Therefore, R1 is moved to a position 850 (shown in phantom) that is near a point V just beyond a pit 852 which is the ultimate target of the present drilling operation. Point V is separated from point U by a distance d4 which is less than or equal to d3. In fact, R2 could be positioned somewhere between pit 852 and R1, since the boring tool would remain in range of both receivers on the remainder of path 840 to the pit. With R1 at position 850, drilling to pit 852 may be completed. It should be appreciated that this "leap-frog" technique may be repeated indefinitely so long as above ground telemetry links 529 and 531 (previously described) remain within range of drill rig 18. Such telemetry links typically use a 460 MHz carrier frequency and have a range exceeding one quarter of a mile. It should also be appreciated that this range could be still further extended using, for example, a relay receiver/transmitter or cabling (neither of which is shown).

The leap-frog technique has been implemented immediately above using only the previously described components of system 500. However, it should be appreciated that additional components may serve to expedite the drilling run. For example a third telemetry receiver (not shown), essentially identical with R1 and R2, may be added to the system such that two receivers remain operational while the third receiver is being relocated such that drilling is continuous. With a suitable number of receivers it is possible to make an extended boring run without the need to move receivers which could reduce labor in performing the run and essentially eliminate interruption of the drilling process.

Referring once again to FIGS. 21 and 22, it should also be appreciated that the leap-frog technique is readily applicable to systems 700 and 800 wherein the receivers described with regard thereto are hardwired (i.e., connected by cables) to the drill rig. In such a case, the addition of two or three telemetry type receivers (such as R1 and R2) and a mapping tool will provide leap frog capability. The added expense of the mapping tool may also be avoided by orienting the telemetry receivers in alternative ways such as described above.

For all systems disclosed herein, the present invention contemplates transmission of a magnetic locating signal from the boring tool using a spread spectrum technique. This technique is highly advantageous in extending through ground range and reducing the effects of interfering signals which are proliferating at a remarkable rate, particularly in urban areas.

In that the boring tool apparatus and associated methods disclosed herein may be provided in a variety of different configurations, it should be understood that the present invention may be embodied in many other specific forms without departing from the spirit or scope of the invention. Therefore, the present examples and methods are to be considered as illustrative and not restrictive, and the invention is not to be limited to the details given herein, but may be modified within the scope of the appended claims.

What is claimed is:

1. A portable mapping tool for use in a horizontal drilling system which includes a boring tool configured for transmitting a locating signal and at least one electromagnetic field detector which is configured for measuring the locating signal from a fixed position proximate to the surface of the ground in a drilling area, said mapping tool comprising:

a) a housing; and b) a transmitter arrangement supported by said housing for transmitting a setup locating signal for reception by said detector in said region for use in determining certain initial conditions at least prior to drilling.

2. The portable mapping tool of claim 1 wherein the locating signal transmitted by the boring tool is a first dipole field and wherein the setup locating signal transmitted by the portable mapping tool is a second dipole field.

3. The portable mapping tool of claim 1 wherein the certain initial conditions include the position of said detector in said region.

4. The portable mapping tool of claim 1 wherein said detector is positioned at a known location on the surface of the ground at said fixed position and wherein said certain initial conditions include an unknown position of the portable mapping tool at another location in said region relative to the detector at the known location.

5. The portable mapping tool of claim 1 wherein said system includes at least a first detector and a second detector at respective first and second spaced apart positions on the surface of the ground and wherein the certain initial conditions include the second position of the second detector relative to the first position of the first detector.

6. The portable mapping tool of claim 1 wherein said system includes a drill rig for actuating the boring tool from a drilling position in said region and wherein the certain initial conditions include the drilling position relative to an at least temporarily fixed position of the portable mapping tool in said region.

7. The portable mapping tool of claim 1 including a positioning arrangement cooperating with said housing for positioning the mapping tool, at least temporarily, on said detector in a predetermined way such that the orientation of the mapping tool is fixed relative to the detector on which it is positioned.

8. The portable mapping tool of claim 7 wherein said positioning arrangement includes an indexing configuration for engaging the detector in said predetermined way to temporarily fixedly maintain the orientation of the portable mapping tool relative to the detector.

9. The portable mapping tool of claim 8 wherein said indexing configuration includes a plurality of indexing pins in a configuration for engaging the detector in said predetermined way to temporarily fixedly maintain the orientation of the portable mapping tool relative to the detector.

10. The portable mapping tool of claim 8 including an arrangement within said housing for determining certain orientation parameters when the mapping tool is engaged with said detector.

11. The portable mapping tool of claim 10 wherein said orientation determining arrangement of the mapping tool includes a configuration for determining the magnetic orientation of the mapping tool and, thereby, the magnetic orientation of said detector when engaged therewith.

12. The portable mapping tool of claim 11 wherein said configuration includes a magnetometer.

13. The portable mapping tool of claim 11 wherein said orientation arrangement includes a tilt sensing arrangement for determining the tilt of the mapping tool and, thereby, the tilt of said detector when engaged therewith.

14. The portable mapping tool of claim 11 wherein said system includes a processing section remote from the portable mapping tool and wherein said portable mapping tool includes a telemetry arrangement for transferring the certain orientation parameters to said processing section.

15. The portable mapping tool of claim 10 wherein said mapping tool includes a display arrangement for displaying the certain orientation parameters.

16. A portable mapping tool for use in a horizontal drilling system which includes a boring tool configured for transmitting a first dipole locating signal and at least one electromagnetic field detector which is configured for measuring the first dipole locating signal from a fixed position proximate to the surface of the ground in a drilling area, said mapping tool comprising:

a) a housing; and b) a transmitter arrangement supported by said housing for transmitting a second dipole locating signal for alternative reception by said detector in said region for use in determining certain initial conditions at least prior to drilling.

17. In a horizontal drilling system which includes a boring tool configured for transmitting a locating signal and at least one electromagnetic field detector which is configured for measuring the locating signal from a fixed position proximate to the surface of the ground in a drilling area, a method comprising the steps of:

configuring a mapping tool for transmitting a setup locating signal for reception by said detector in said region and using the received setup locating signal in determining certain initial conditions at least prior to drilling.

18. The method of claim 17 wherein the locating signal transmitted by the boring tool is a first dipole field and including the step of transmitting a second dipole field as the setup locating signal from the portable mapping tool.

19. The method of claim 17 wherein the step of determining certain initial conditions includes the step of establishing the position of said detector in said region.

20. The method of claim 17 including the step of positioning said detector at a known location on the surface of the ground as said fixed position and the step of determining said certain initial conditions includes the step of establishing an unknown position of the mapping tool at another location in said region relative to the detector at the known location.

21. The method of claim 17 wherein said system includes at least a first detector and a second detector at respective first and second spaced apart positions on the surface of the ground and wherein the step of determining certain initial conditions includes the step of establishing the second position of the second detector relative to the first position of the first detector.

22. The method of claim 17 wherein said system includes a drill rig for actuating the boring tool from a drilling position in said region and the step of determining the certain initial conditions includes the step of establishing the drilling position relative to an at least temporarily fixed position of the mapping tool in said region.

23. The method of claim 17 including the step of positioning the mapping tool, at least temporarily, on said detector in a predetermined way such that the orientation of the mapping tool is fixed relative to the detector on which it is positioned prior to transmitting the setup locating signal.

24. The method of claim 23 wherein said positioning step includes the steps of configuring the mapping tool with an indexing configuration to engage the detector in a predetermined way when positioned thereon and using the indexing configuration to temporarily fixedly maintain the orientation of the mapping tool relative to the detector.

25. The method of claim 24 wherein the step of configuring the indexing configuration includes the step of defining a plurality of indexing pins for engaging the detector in said predetermined way to temporarily fixedly maintain the orientation of the portable mapping tool relative to the detector.

26. The method of claim 24 including the step of providing an orientation determining arrangement as part of said mapping tool for determining certain orientation parameters when the mapping tool is engaged with said detector.

27. The method of claim 26 including the step of configuring the orientation determining arrangement for determining the magnetic orientation of the mapping tool and, thereby, the magnetic orientation of said detector when engaged therewith.

28. The method of claim 27 including the step of using a magnetometer in determining the magnetic orientation of the mapping tool as part of the orientation determining arrangement.

29. The method of claim 27 including the step of using a tilt sensing arrangement, as part of the orientation determining arrangement, in determining the tilt of the mapping tool and, thereby, the tilt of said detector when engaged therewith.

30. The method of claim 27 wherein said system includes a processing section remote from the mapping tool and including the step of transferring the certain orientation parameters to said processing section using telemetry.

31. The method of claim 27 including the step of configuring the mapping tool to include a display arrangement for displaying the certain orientation parameters.

32. In a horizontal drilling system which includes a boring tool configured for transmitting a first dipole locating signal and at least one electromagnetic field detector which is configured for measuring the locating signal from a fixed position proximate to the surface of the ground in a drilling area, a method comprising the steps of:

configuring a mapping tool for transmitting a second dipole locating signal for alternative reception by said detector in said region for use in determining certain initial conditions at least prior to drilling.

* * * * *